US012636550B2

(12) United States Patent
Moore et al.

(10) Patent No.: US 12,636,550 B2
(45) Date of Patent: May 26, 2026

(54) ADJUSTABLE GOLF CLUB

(71) Applicant: Q Golf Ltd, New Plymouth (NZ)

(72) Inventors: Simon Moore, New Plymouth (NZ); Daniel Barry, Christchurch (NZ)

(73) Assignee: Q Golf Ltd (NZ)

( * ) Notice: Subject to any disclaimer, the term of this patent is extended or adjusted under 35 U.S.C. 154(b) by 1059 days.

(21) Appl. No.: 17/698,820

(22) Filed: Mar. 18, 2022

(65) Prior Publication Data

US 2022/0296970 A1 Sep. 22, 2022

(30) Foreign Application Priority Data

Mar. 19, 2021 (AU) ..... 2021201742
Oct. 19, 2021 (AU) ..... 2021254532

(51) Int. Cl.
*A63B 53/02* (2015.01)

(52) U.S. Cl.
CPC ..... *A63B 53/026* (2020.08)

(58) Field of Classification Search
CPC ..... A63B 53/026; A63B 2071/0694; A63B 53/047; A63B 53/06
See application file for complete search history.

(56) References Cited

U.S. PATENT DOCUMENTS 2,329,313 A * 9/1943 Winter ..... A63B 60/00 473/247
4,878,666 A * 11/1989 Hosoda ..... A63B 53/02 473/247
5,928,087 A * 7/1999 Emberton ..... A63B 60/00 403/97
9,144,720 B1 * 9/2015 Vrska ..... A63B 53/02

* cited by examiner

*Primary Examiner* — Jeffrey S Vanderveen
(74) *Attorney, Agent, or Firm* — Gloria Tsui-Yip; Gottlieb, Rackman & Reisman, P.C.

(57) ABSTRACT

A golf club or part thereof may include a ball-strike head 1, a hosel 2 having a shank 5 that extends along at least part of, and that engages with, the head, biasing means (eg a spring 9) that provides a locking force that seeks to move the head 1 and hosel apart 2 and, in doing so, causes the head to remain locked in one or other of a selection of loft settings 4. The club or part thereof being such that hand force can be applied to move the head 1 inwards to overcome the locking force to free the head to be turned into another of the loft settings 4. The arrangement is such that subsequent reverse movement of the head will cause it to be locked in that other setting.

18 Claims, 27 Drawing Sheets

DETAIL D
SCALE 2 : 1

DETAIL E
SCALE 2 : 1

DETAIL A
SCALE 2 : 1

DETAIL B
SCALE 2 : 1

DETAIL C
SCALE 2 : 1

DETAIL D
SCALE 2 : 1

DETAIL E
SCALE 2 : 1

DETAIL I
SCALE 2 : 1

DETAIL J
SCALE 5 : 1

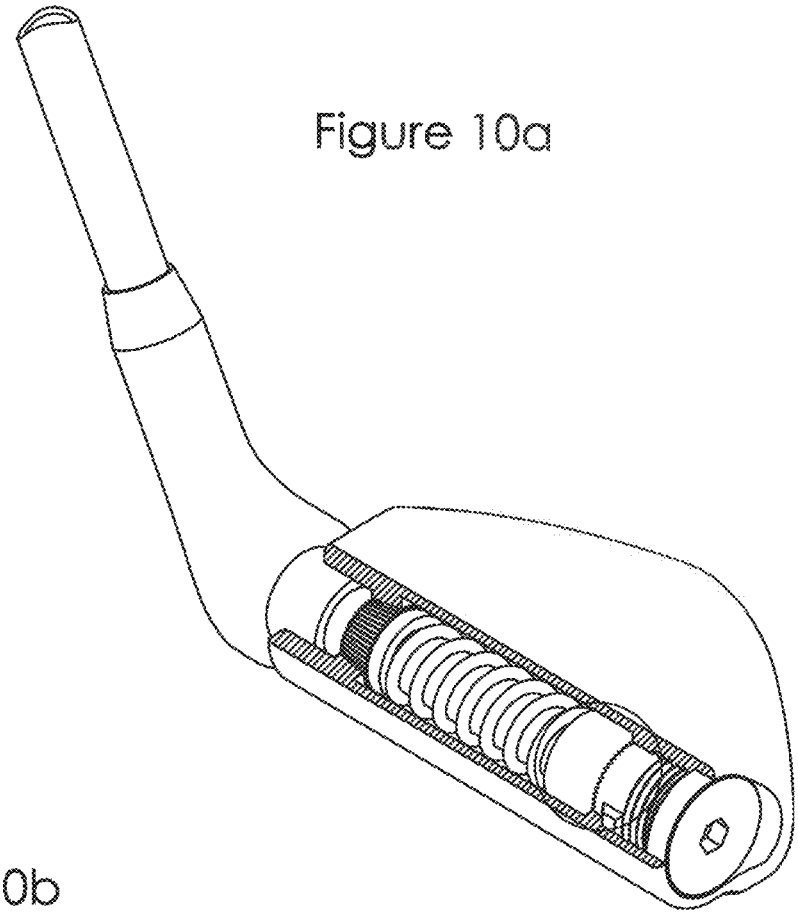
Figure 10a
Figure 10b
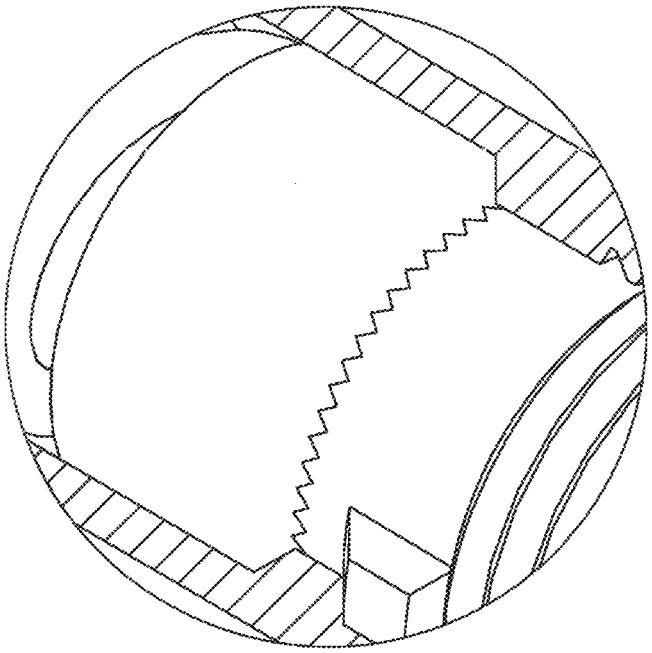

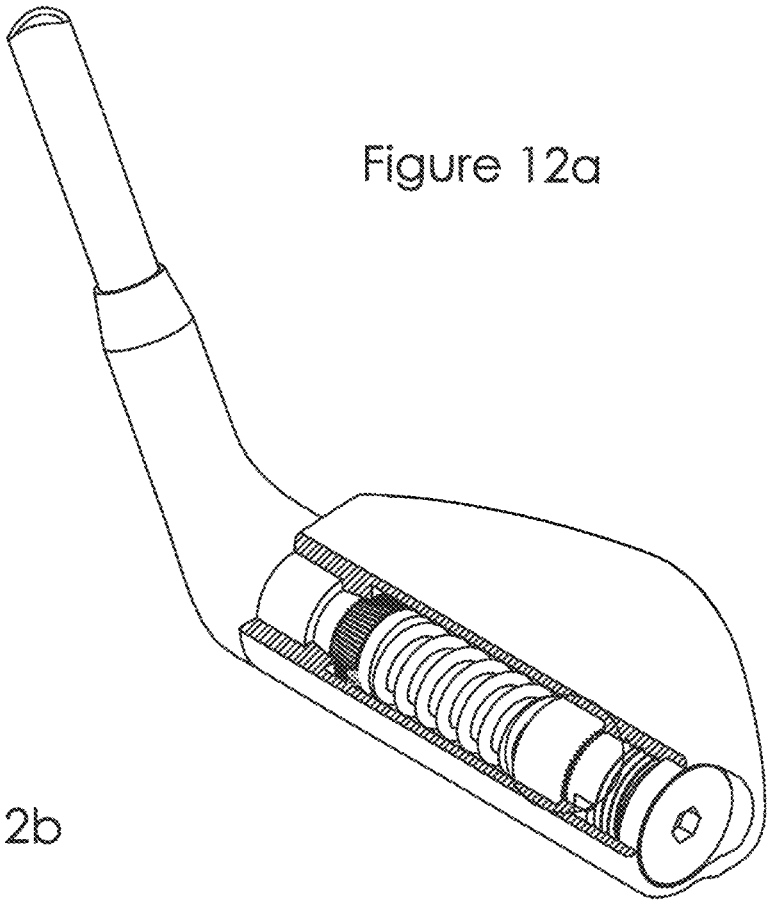
Figure 12a
Figure 12b
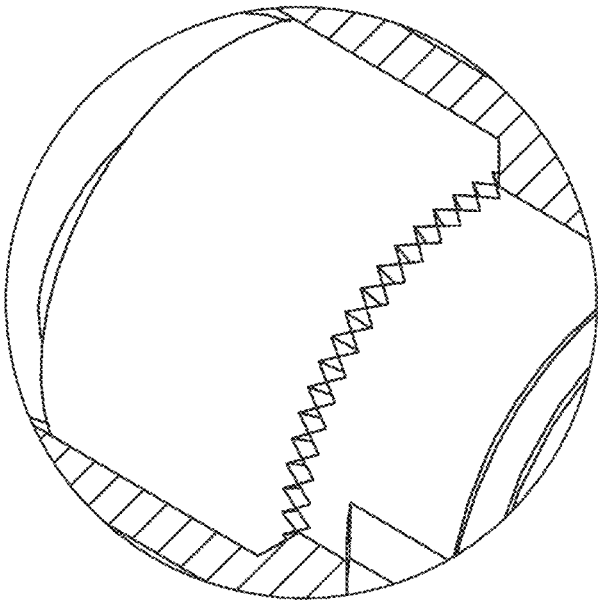

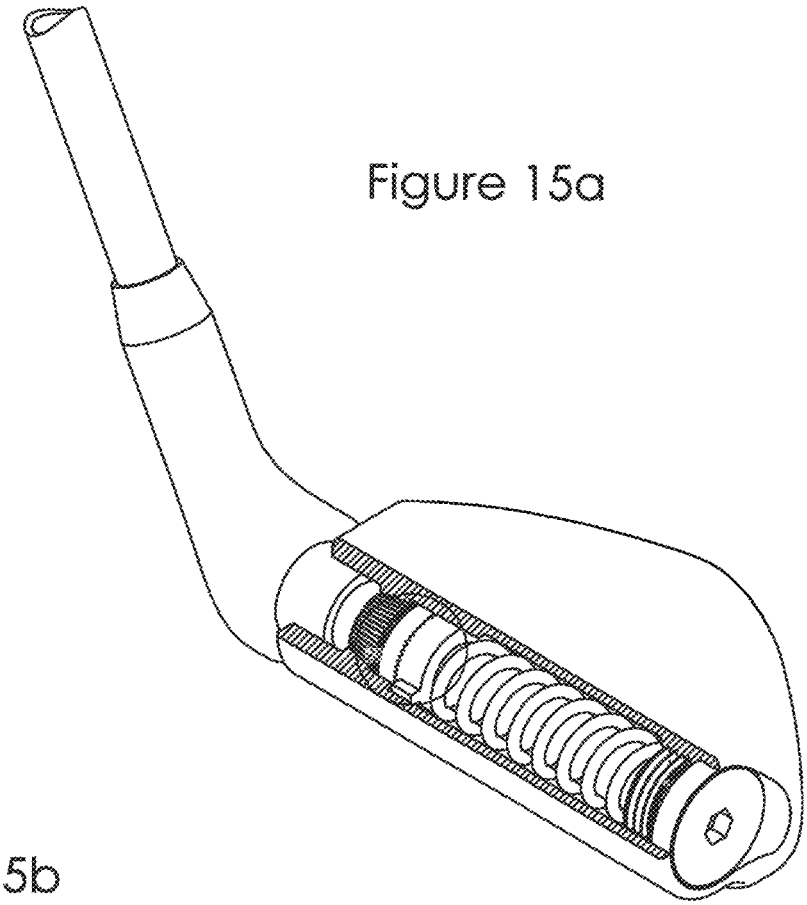
Figure 15a
Figure 15b
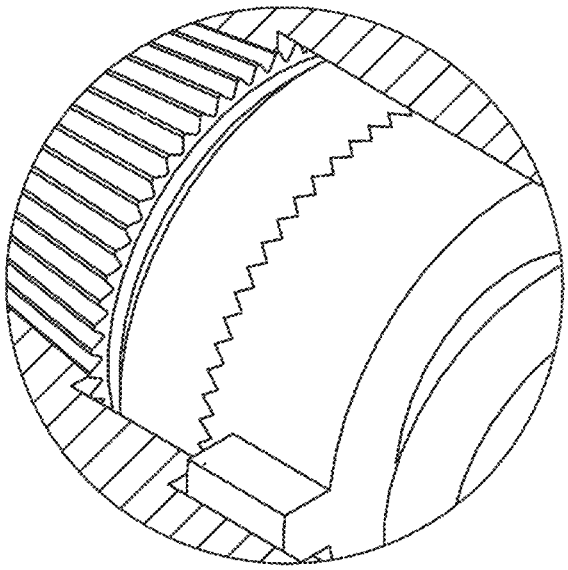

ADJUSTABLE GOLF CLUB

FIELD OF INVENTION

This invention relates to a golf club that has adjustable loft settings.

BACKGROUND

It is known for golf clubs to have facility to adjust the angle of the ball-striking head so as to change the loft of the club overall. As is known, all things being equal, a head set at a steep angle (eg 60°) causes a golf ball to fly through a steeper and shorter trajectory than a club where the head is at a lessor angle (eg 10°). The adjustability means that one club can be used to give the same loft range as several clubs. However a problem with at least some known clubs of this type is that the adjustment mechanism is inconvenient to produce and/or use. Also, a problem with known clubs of this type is that the person doing the loft adjustment is not given any audible or tactile feedback during adjustment of the club.

OBJECT

It is an object of preferred embodiments of the invention to go at least some way towards addressing one or other of the above problems. While this applies to preferred embodiments, the object of the invention per se is simply to provide a useful choice. Therefore, any objects or advantages applicable to preferred embodiments should not be taken as a limitation on claims expressed more broadly.

Definitions

The term "comprises" or "has", if and when used in this document in relation to one or more features, should not be seen as excluding the option of there being additional unmentioned features. The same applies to derivative terms such as "comprising" and "having".

SUMMARY OF THE INVENTION

Aspect 1

Locking Mechanism

In a first aspect of the invention there is provided a golf club or part thereof, comprising:

- a ball-strike head;
- a hosel having a shank that extends along at least part of, and that engages with, the head; and
- biasing means that provides a locking force that seeks to move the head and hosel apart and, in doing so, causes the head to remain locked in one or other of a selection of loft settings;
- the golf club or part thereof being such that hand force can be applied to move the head inwards to overcome the locking force to free the head to be turned into another of the loft settings, and such that subsequent reverse movement of the head will cause it to be locked in that other setting;
- wherein the head has a series of locking teeth and the hosel has a series of locking teeth, these being arranged such that they intermesh to lock the head in any of the loft settings and subsequently disengage when the head has been moved by hand to overcome the locking force to enable the head to be turned to another of the loft settings; and

- the two series of locking teeth are in a male-female engagement wherein the teeth of the hosel are male and the teeth of the head are female, and each set of teeth is substantially conical and tapers outwards in the direction of the toe end of the club or part thereof.

Optionally the locking force bias drives the head outwards to cause the head to be locked in said other setting.

Optionally the biasing force is provided by a spring.

Optionally the spring is arranged around the shank.

Optionally the locking teeth of the head and the hosel each comprise a set of radially longitudinally extending teeth.

Optionally the hosel's set of teeth sleeve-fit into, and mesh with, the head's set of teeth when the head is locked in any one of the loft settings.

Optionally there is a nut fitted to a toe end of the shank, a retainer secured to the shank by the nut, and the retainer being in butting relationship with the head when the head is locked in one of the loft settings so that the head cannot be pulled free of the shank.

Optionally the butting relationship is between the retainer and a liner forming part of the head.

Optionally the liner is releasably screw-fitted to another part of the head.

Aspect 2

Locking Mechanism

In a further aspect of the invention there is provided a golf club comprising:

- a ball-strike head having a cone shaped series of locking teeth arranged such that each of these teeth extend in a straight line;
- a hosel having a cone shaped series of locking teeth arranged such that each of these teeth extend in a straight line, and a shank that extends along at least part of, and that engages with, the head;
- biasing means that provides a spring locking force that seeks to move the head and hosel apart and, in doing so, causes the head to remain locked in one or other of a selection of loft settings;
- the two series of locking teeth being arranged such that the cone shape of one sleeve-fits into the cone shape of the other in a meshed male-female relationship to lock them against rotation, but wherein hand force can be applied to move the head inwards to free the head to be turned into another of the loft settings, and such that subsequent reverse movement of the head will cause it to be locked in that other setting.

Aspect 3

Audible & Tactile Adjustments

In a further aspect the invention there is provided a golf club or part therefor comprising:

a) a ball-strike head;

b) a hosel; and c) slip gears;

the club or part therefor being formed such that:

- the head and the hosel engage one another to releasably lock the head in one of a plurality of loft settings;
- spring force acts on the slip gears to bias the teeth of one slip gear to engage with teeth of another;
- hand force can be applied to the head to rotate it into another of the loft settings to be locked in that other loft setting; and
- as the head is rotated into said other loft setting at least one of the slip gears rides over another of them to generate a click sound and/or a tactile indication to give a person adjusting the club audible and/or tactile feedback of the adjustment.

Optionally— a) The ball-strike head is integral with or secured to a first locking gear comprising splines;

b) the hosel is integral with or secured to a second locking gear comprising splines;

c) spring force acts on the locking gears to bias them to engage one another;

d) hand force can be applied to the head to move it towards the heel of the club against the bias on the locking gears to unlock the head so that it can be hand rotated into the other of the loft settings and then released such that the same bias causes the head to be locked in that other loft setting.

Optionally the spring force that acts on the male and female gears and the spring force that acts on the slip gears is provided by a common spring.

Optionally the common spring is compressed to assert a force that urges the head away from the heel of the club and, at the same time, urges at least one of the slip gears to engage another.

Optionally the spring force acting on the locking gears is provided by a first spring, and the spring force acting on the slip gears is provided by a second spring.

Optionally the first spring provides substantially less force than the second spring.

Optionally the first and second springs comprise elongate coils that are arranged substantially in line with one another.

Optionally a central portion of the first spring has nothing supportive extending through it (eg it is not associated with an internally arranged shaft or the like).

Optionally the slip gears comprise an inner slip gear, a medial slip gear and an outer slip gear, the click sound being generated when teeth of one or other of the inner and outer slip gears clash with teeth of the medial slip gear.

Optionally— a) the first locking gear is a female gear and its splines run in a longitudinally tapered configuration and the taper extends from narrower to wider as it proceeds towards the toe end of the club; and b) the second locking gear is a male gear and its splines also run in a longitudinally tapered configuration and the taper extends from narrower to wider as it proceeds towards the toe end of the club.

Optionally one of the slip gears is unable to rotate.

Optionally the first locking gear engages the shaft at the heel end of the club.

Optionally the second locking gear is secured inside, or is integral with the inside, of the head.

Optionally the slip gears are adjacent to the toe end of the club.

Optionally each slip gear has the same number of gear teeth as each of the first locking and second locking gears.

Optionally the slip gears are coordinated with the first and second locking gears such that rotation of the head into the other loft setting produces only one audible click per change in loft setting.

Optionally the slip gears are coordinated with the first and second locking gears such that rotation of the head into the other loft setting produces one tactile bump that corresponds with the audible click.

Optionally there are more than two of the loft settings and the loft of the head can be adjusted by rotating it to each setting in turn in the same way.

Optionally the tactile indicator is a bump or vibration that can be felt by the person when the slip gear rides over the other slip gear.

DRAWINGS

Some preferred embodiments of the invention will now be described by way of example and with reference to the accompanying drawings, of which—

FIG. 1 is an isometric view of a 'loft-adjustable' golf club;

FIG. 1*a* illustrates loft settings of the club when viewed from the club's toe end;

FIG. 1*b* illustrates the same loft settings when viewed from the heel end of the club;

Figure 4:
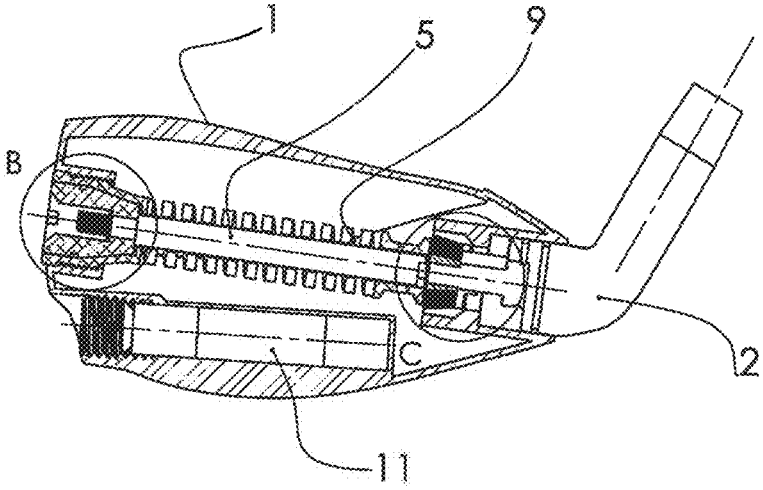
FIG. 4 illustrates the club in side view cross-section when the club's head is locked in one of its loft settings.
Figure 4:
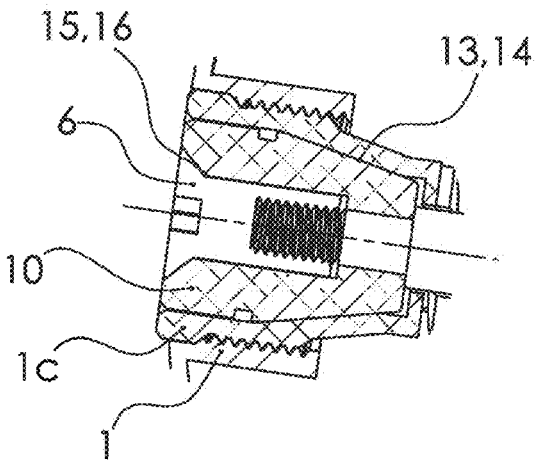
Figure 4:
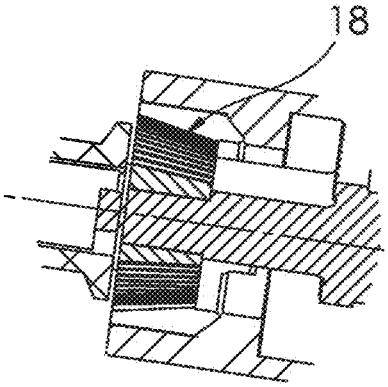
Figure 4A:
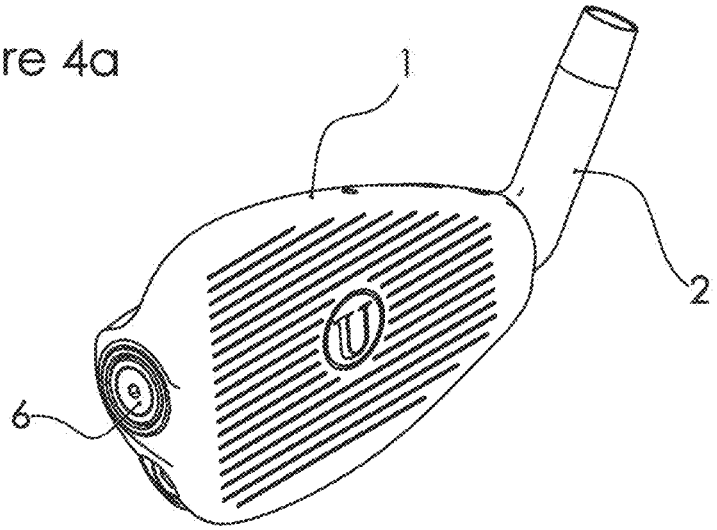
Figure 5:
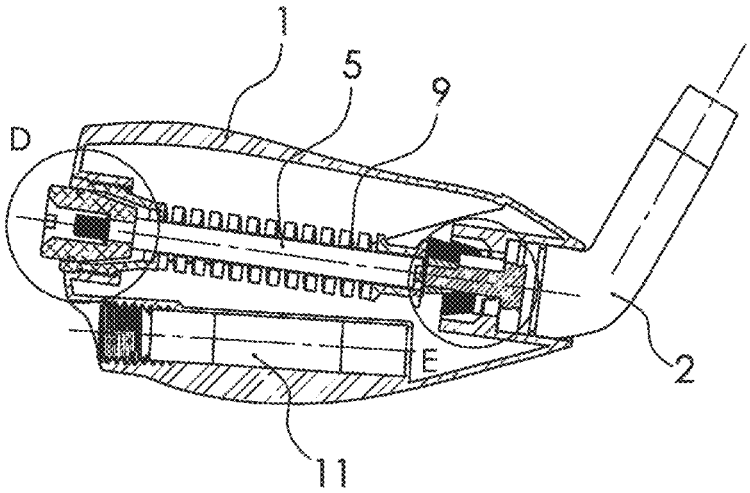
Figure 5:
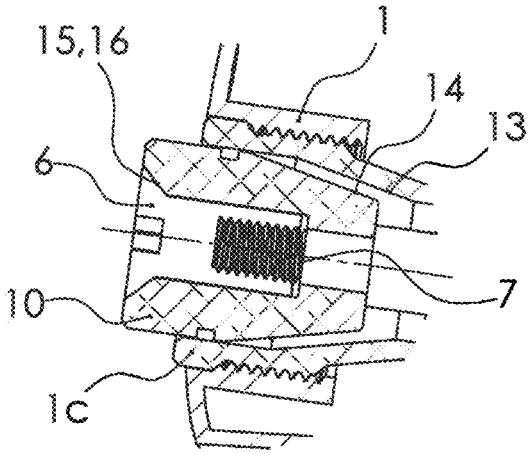
Figure 5:
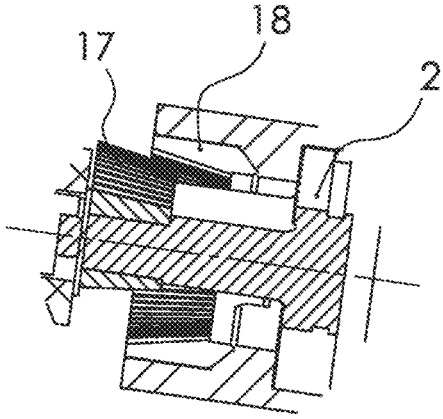
Figure 5A:
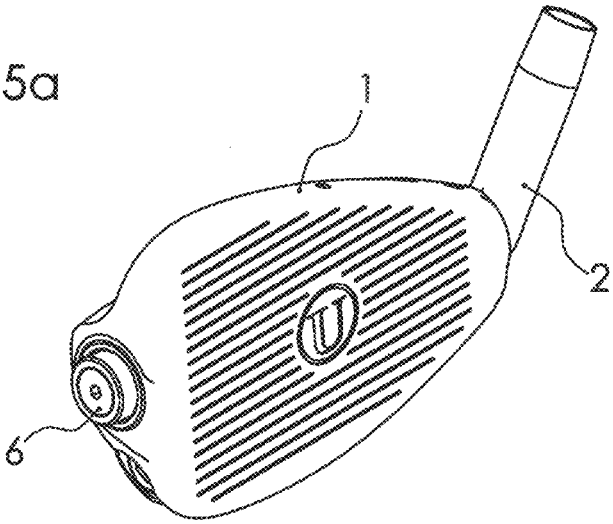
Figure 6:
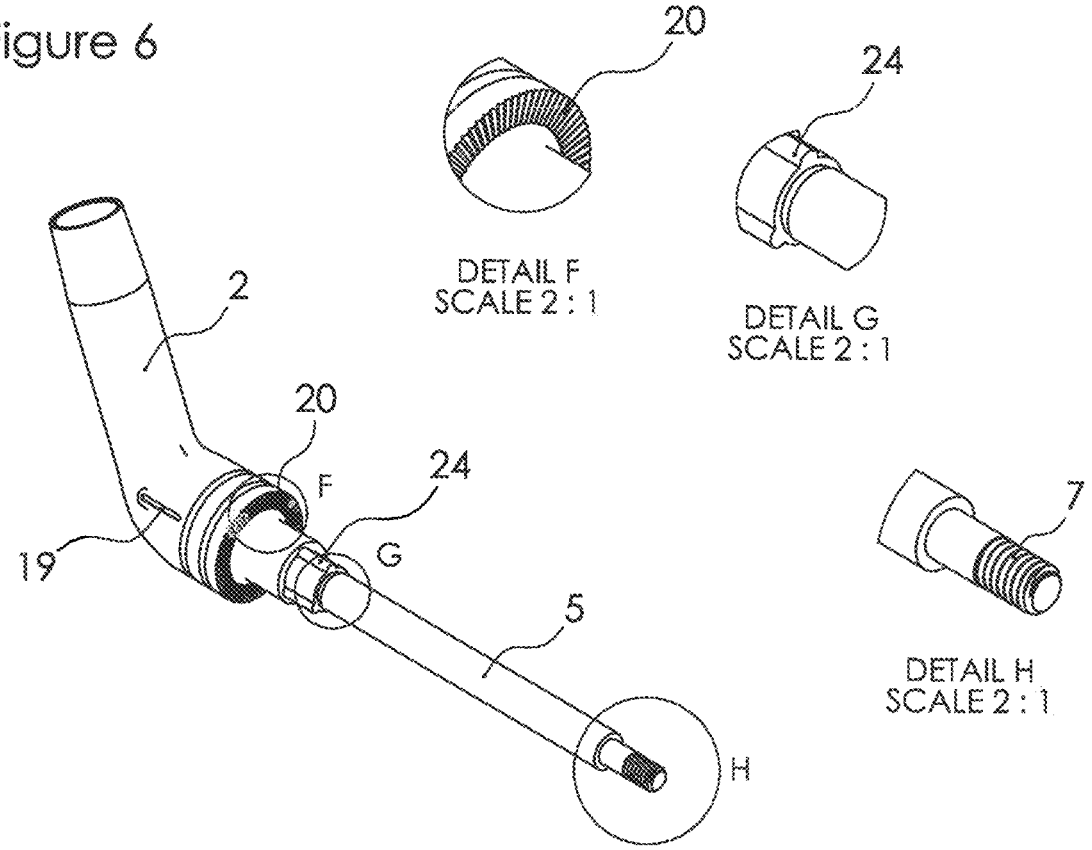
Figure 6A:
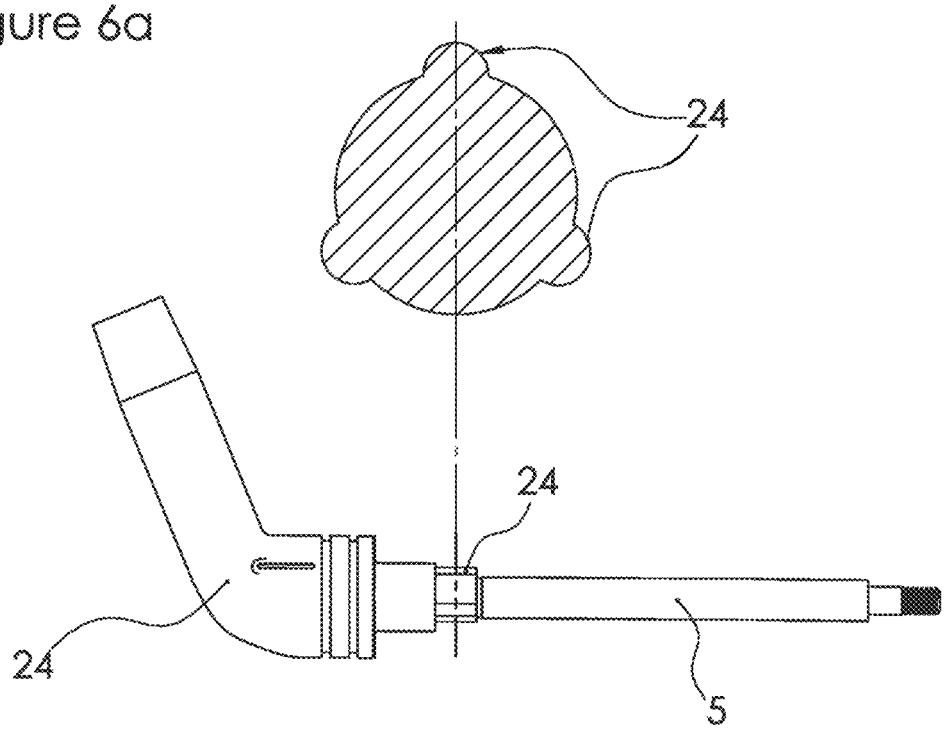
Figure 7:
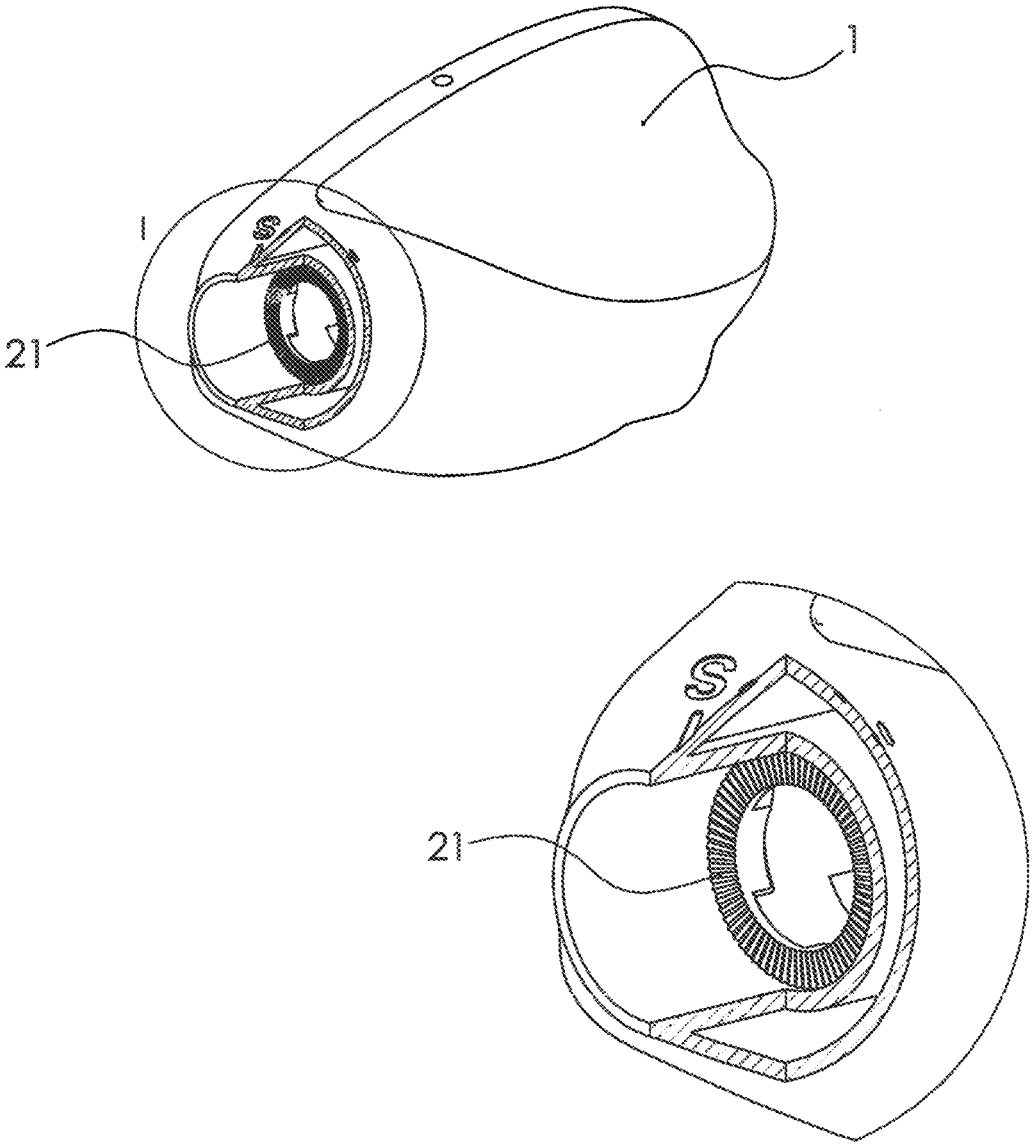
Figure 8:
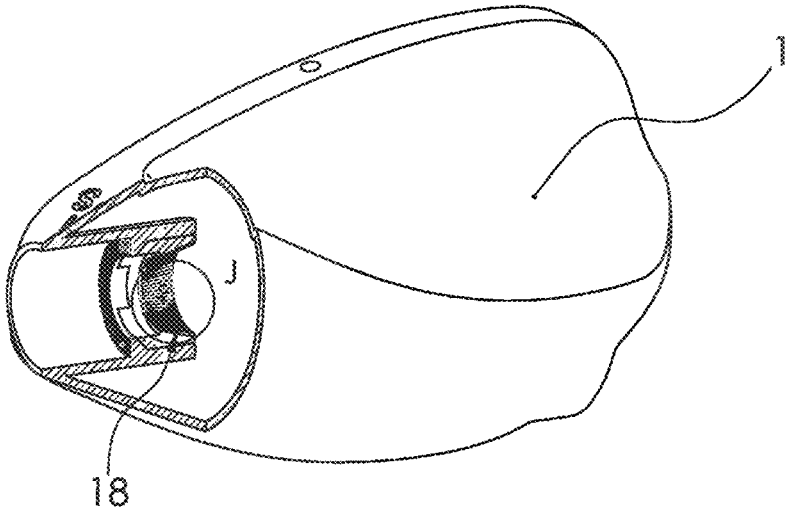
Figure 8:
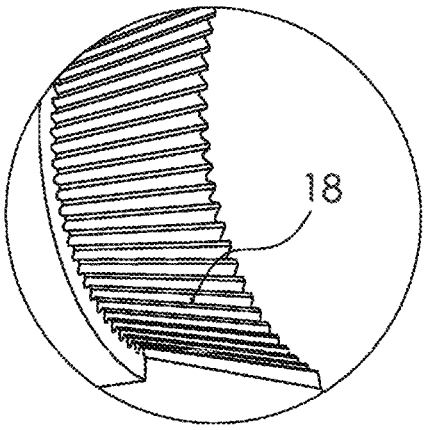
Figure 9:
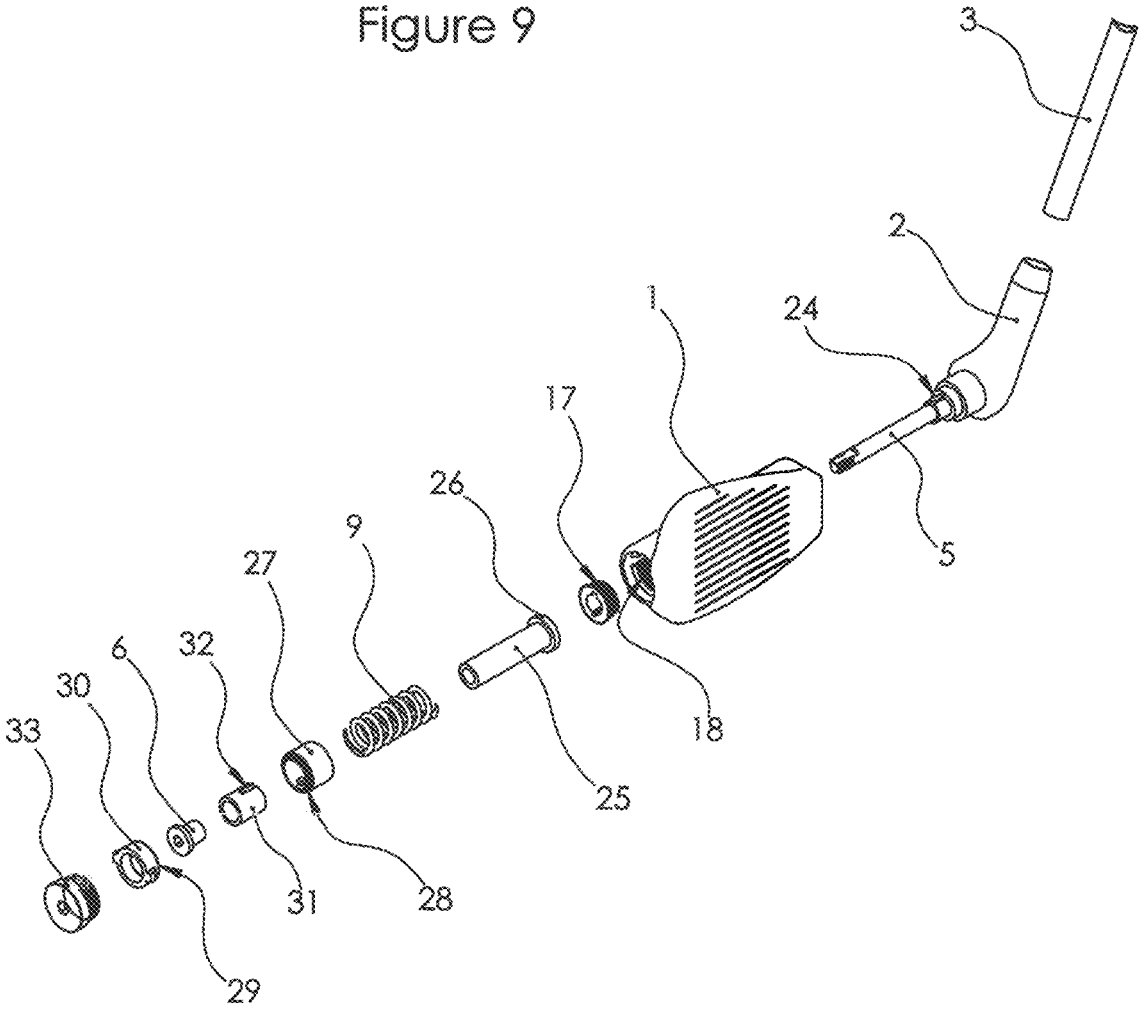
Figure 11A:
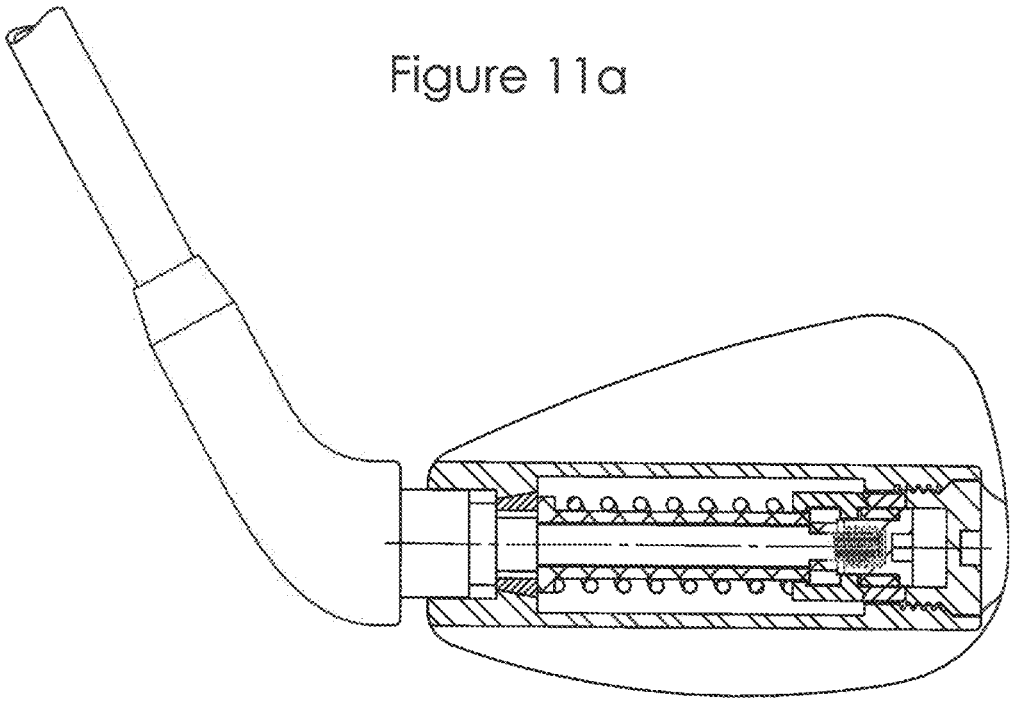
Figure 11B:
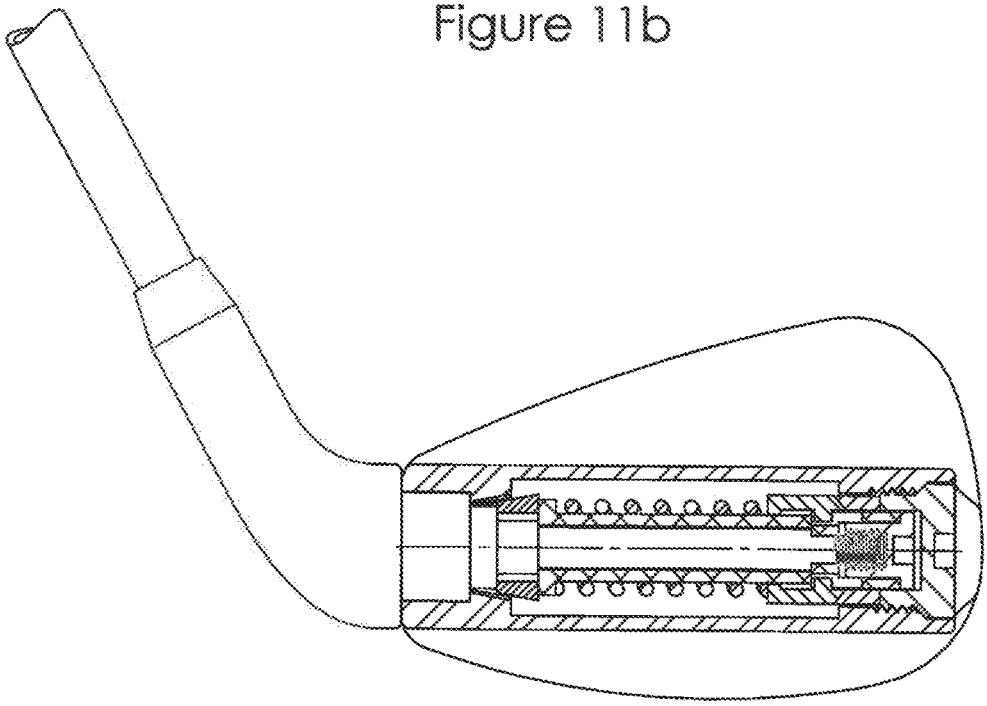
Figure 13:
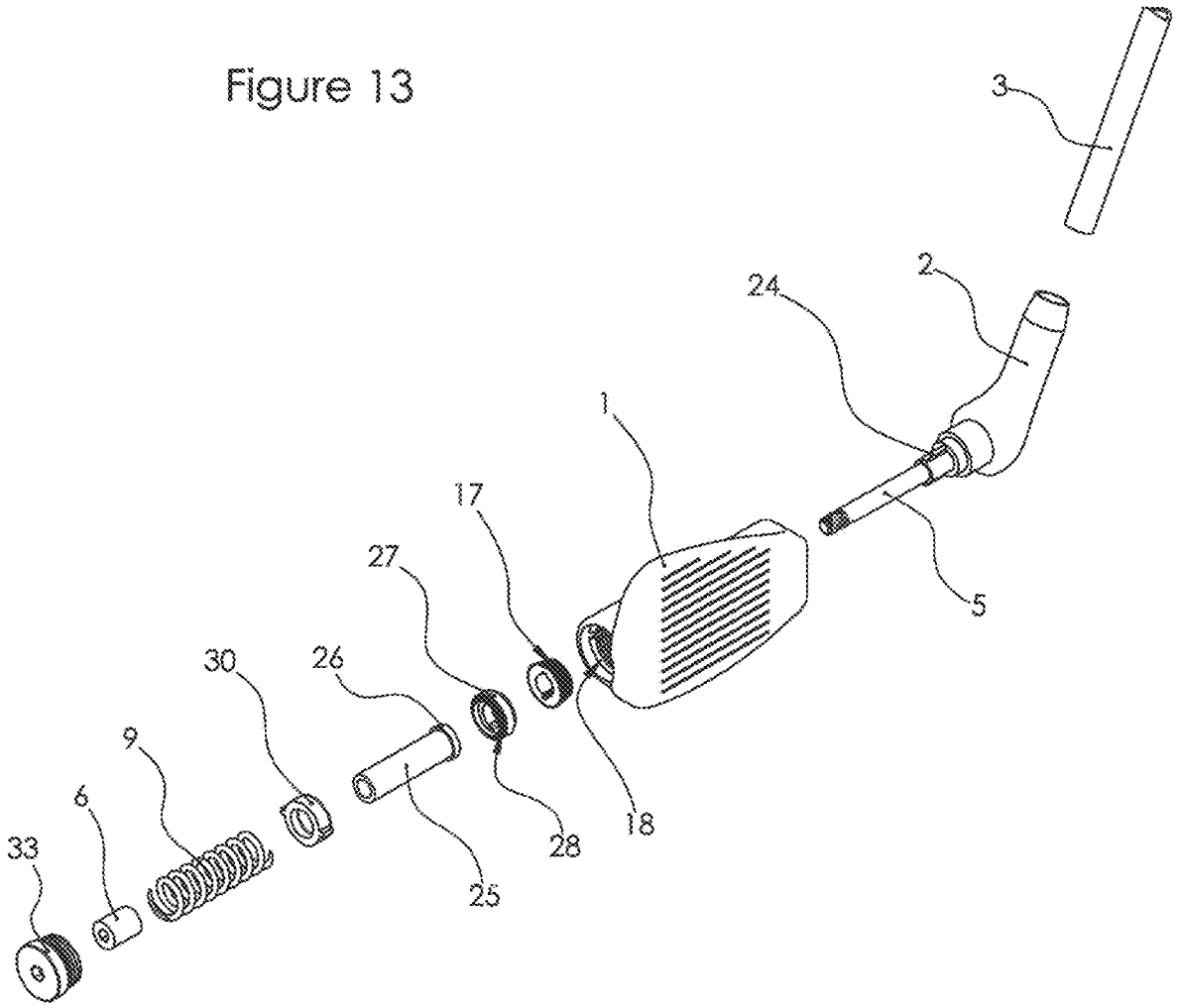
Figure 14A:
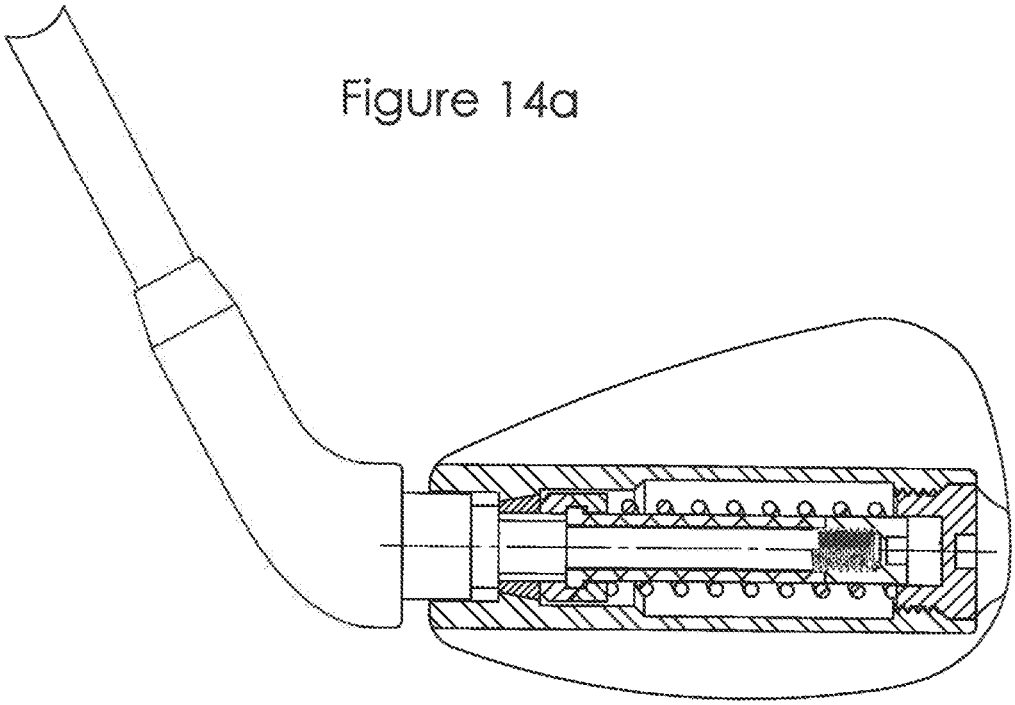
Figure 14B:
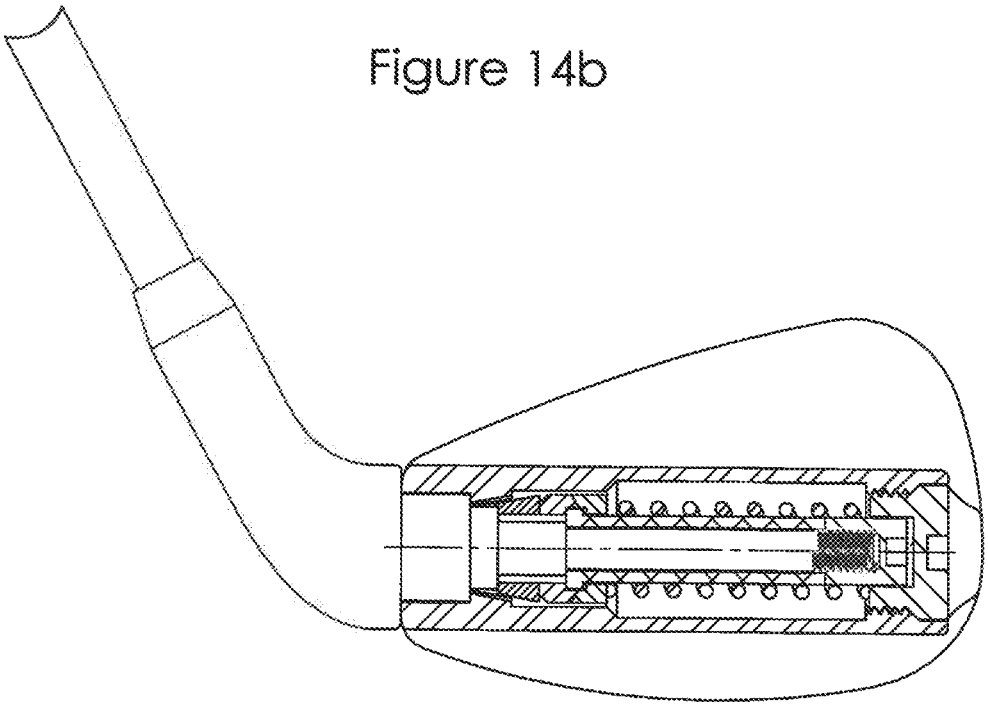
Figure 16:
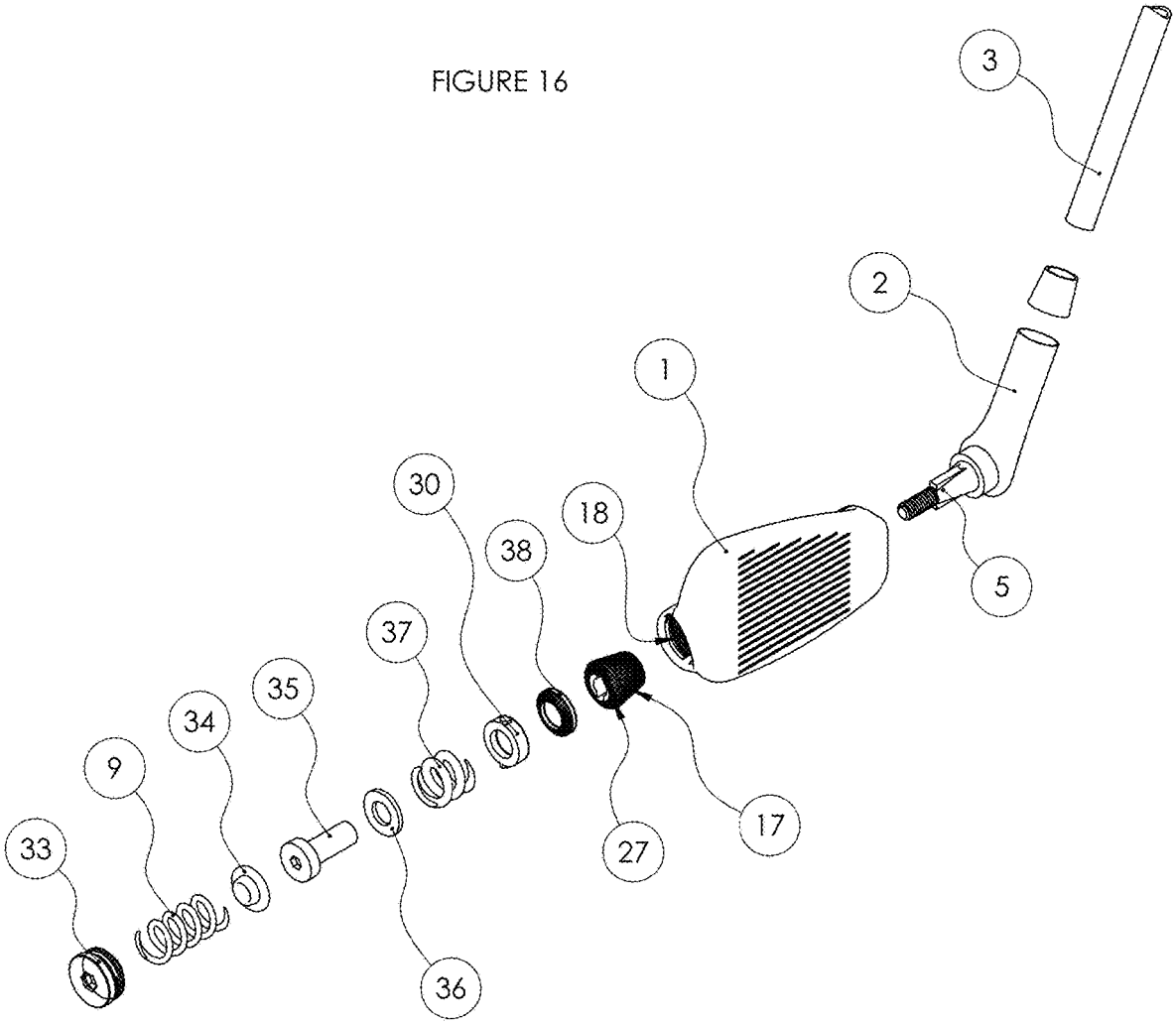
Figure 17:
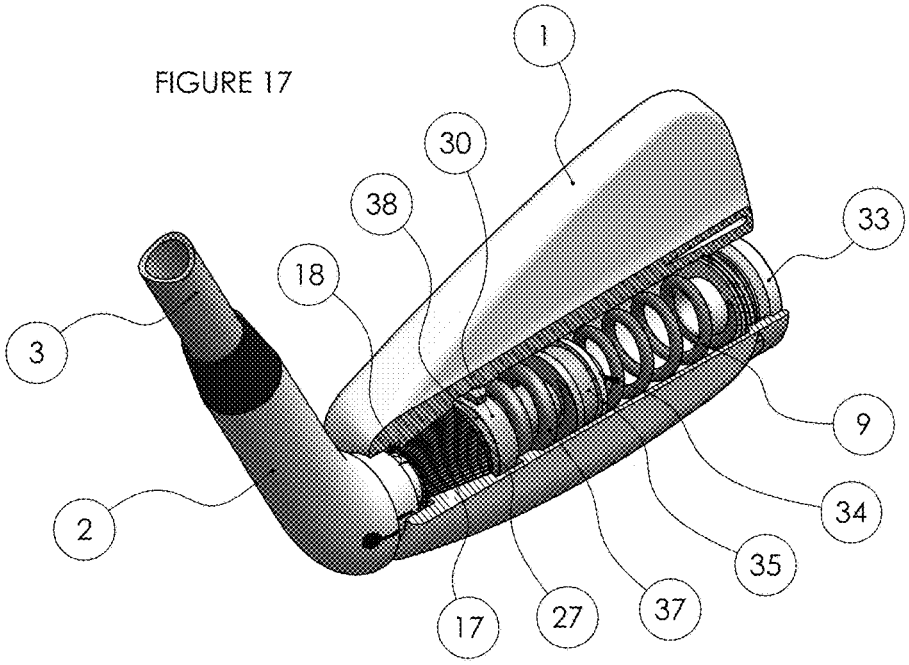
Figure 18:
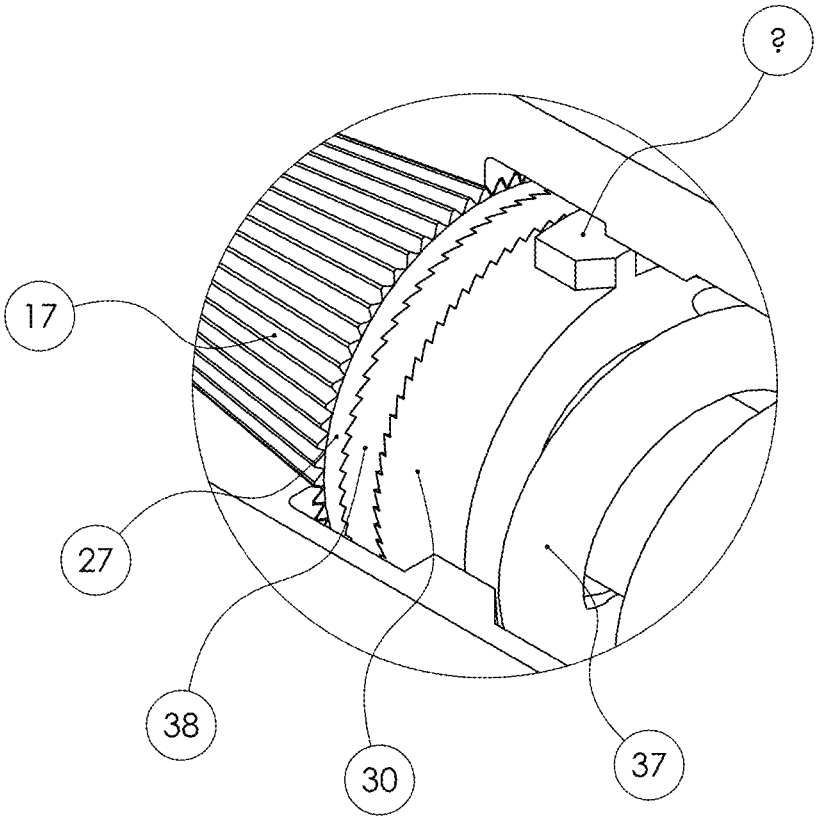
Figure 19A:
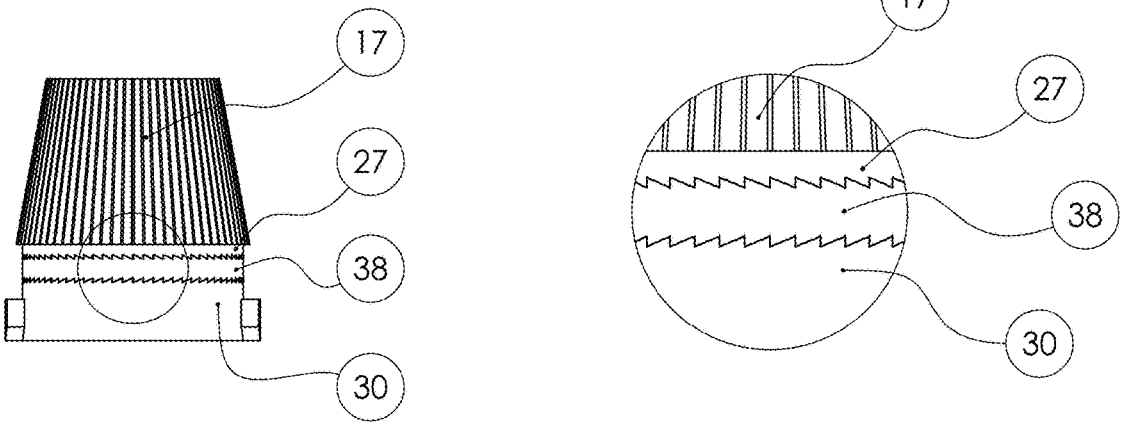
Figure 19B:
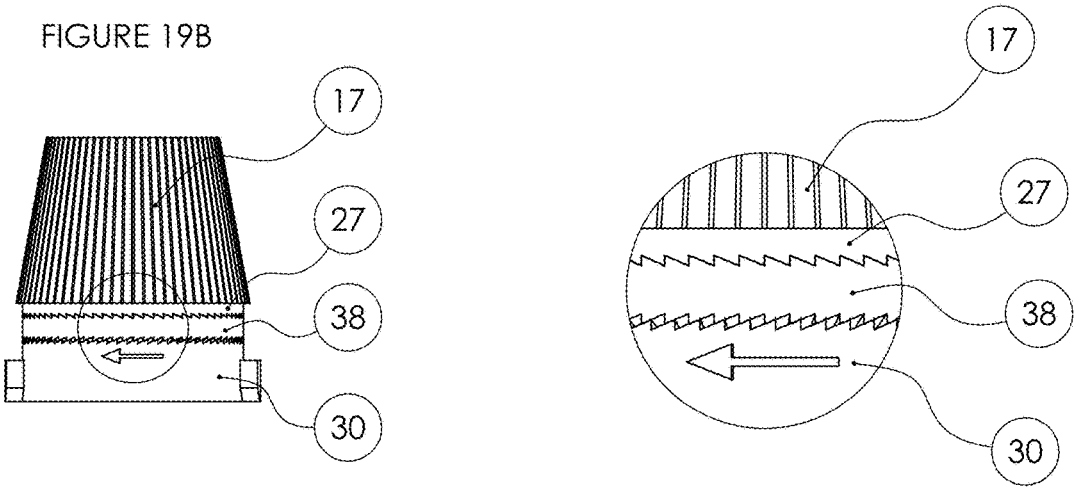
Figure 19C:
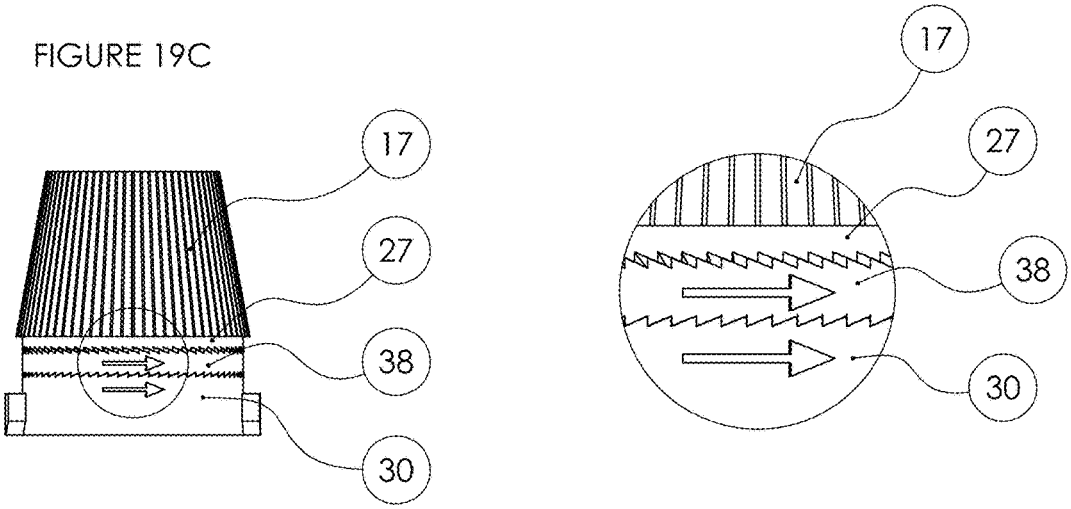
Figure 20:
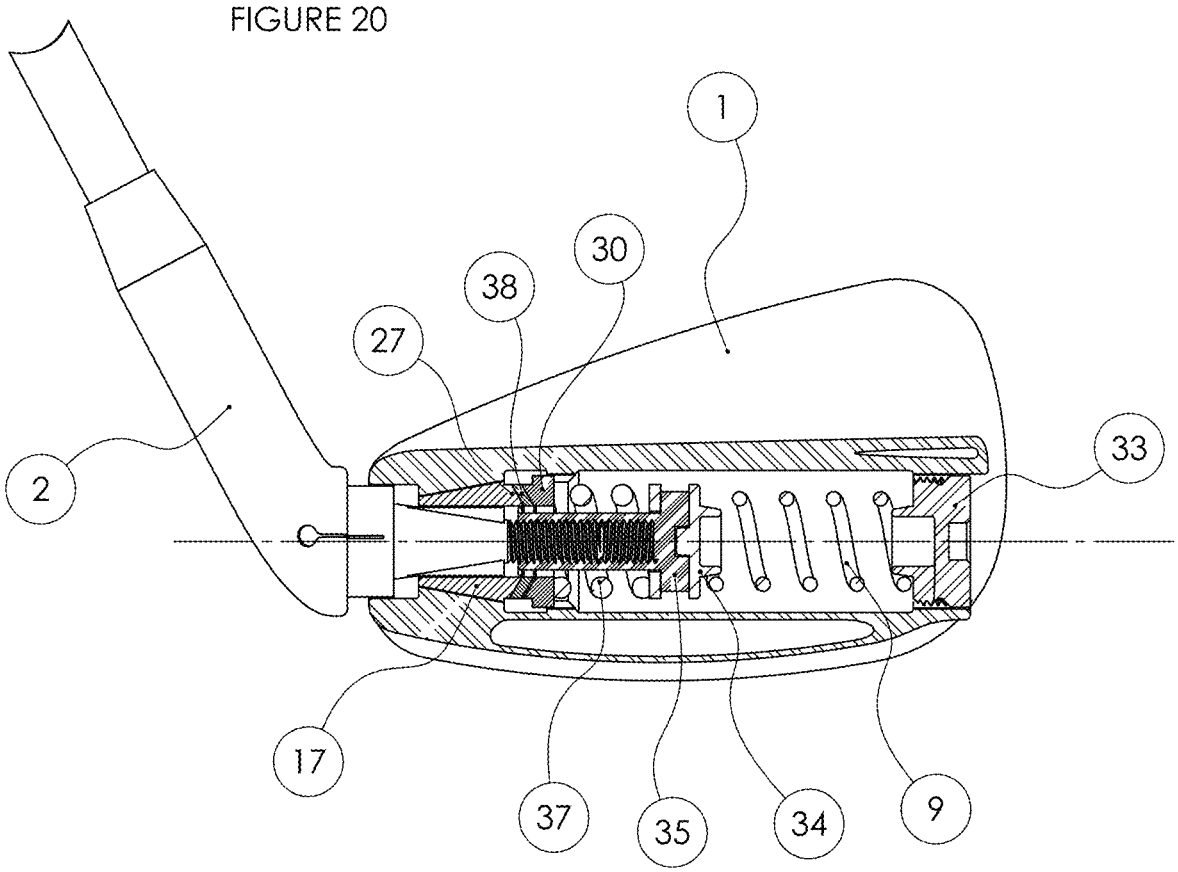
Figure 21:
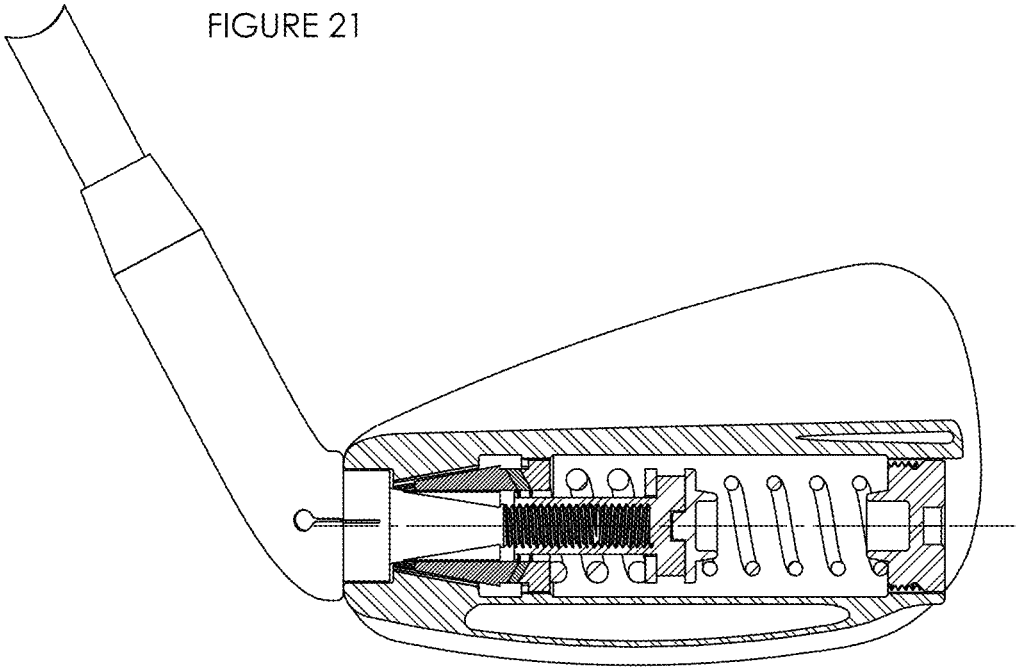
Figure 22:
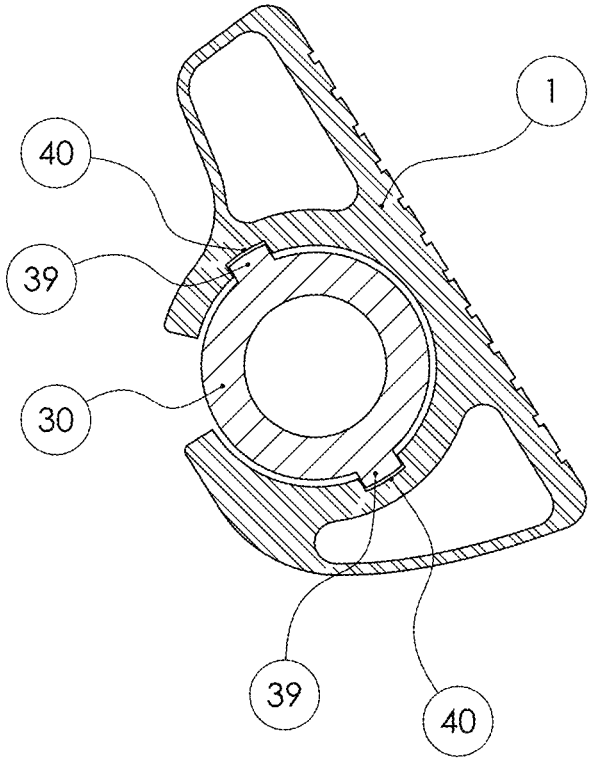
Figure 23:
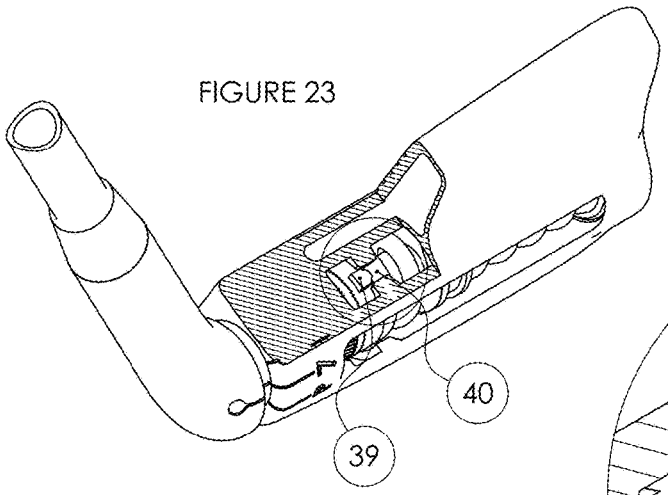
Figure 24:
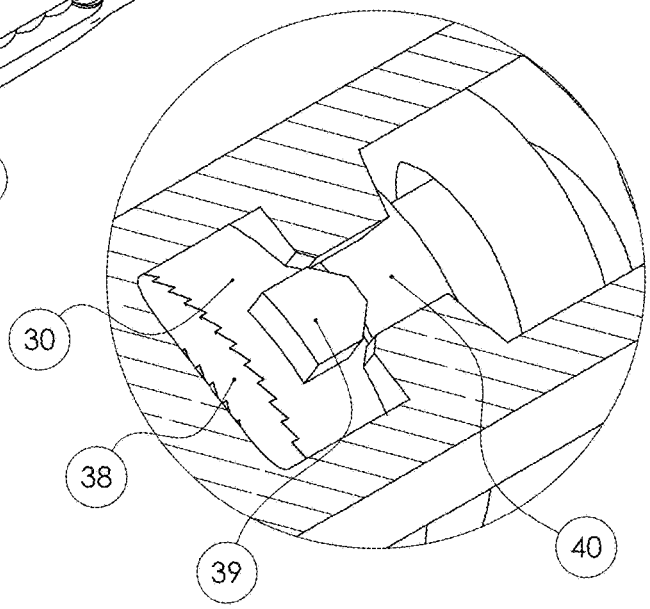
Figure 25:
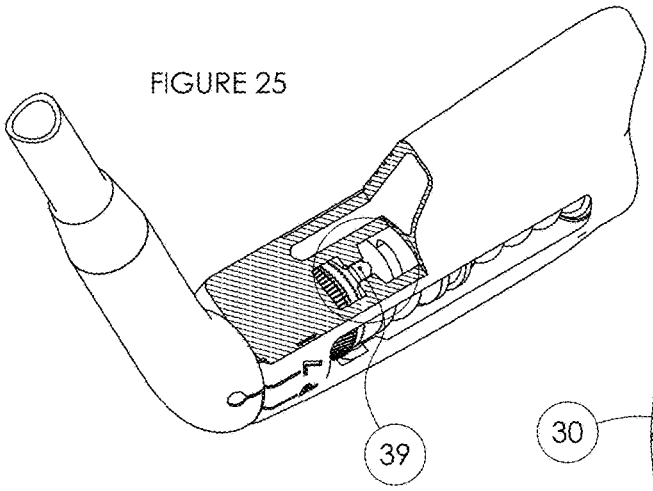
Figure 26:
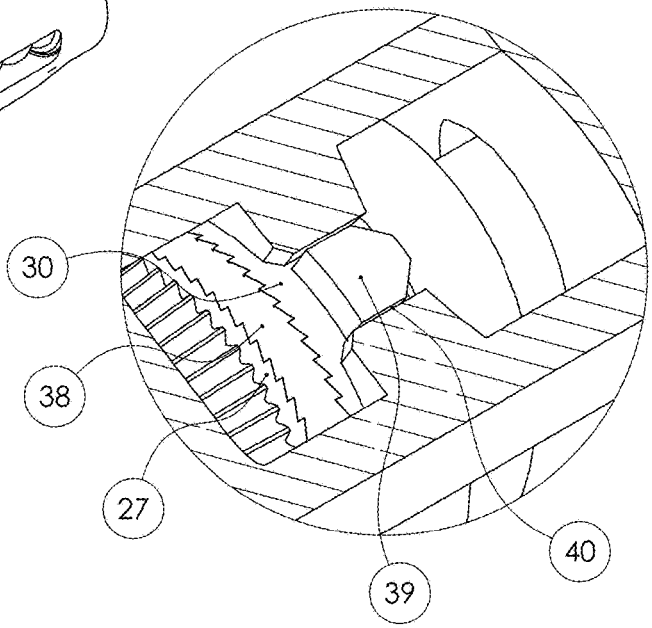
Figure 27:
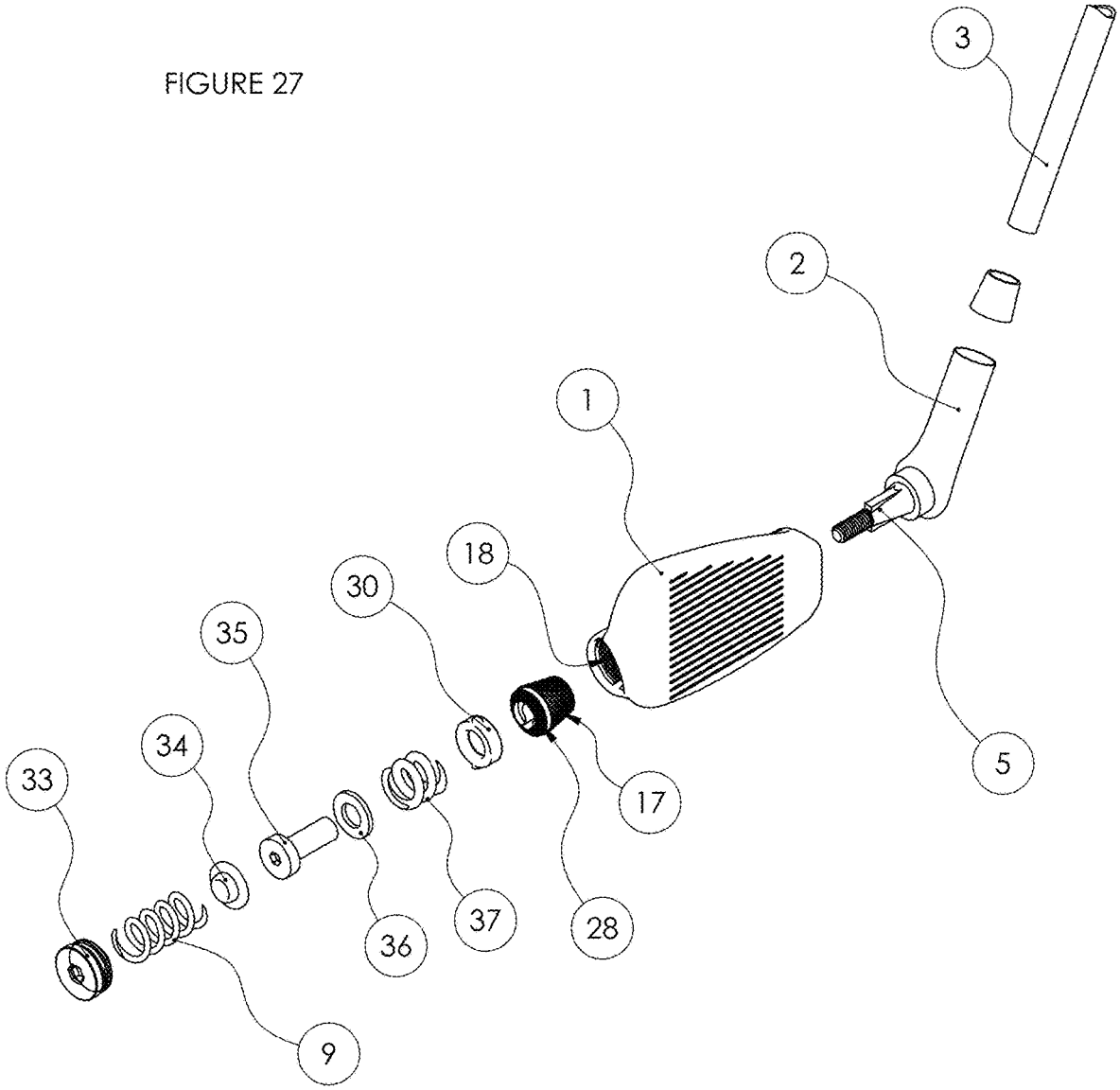
Figure 28:
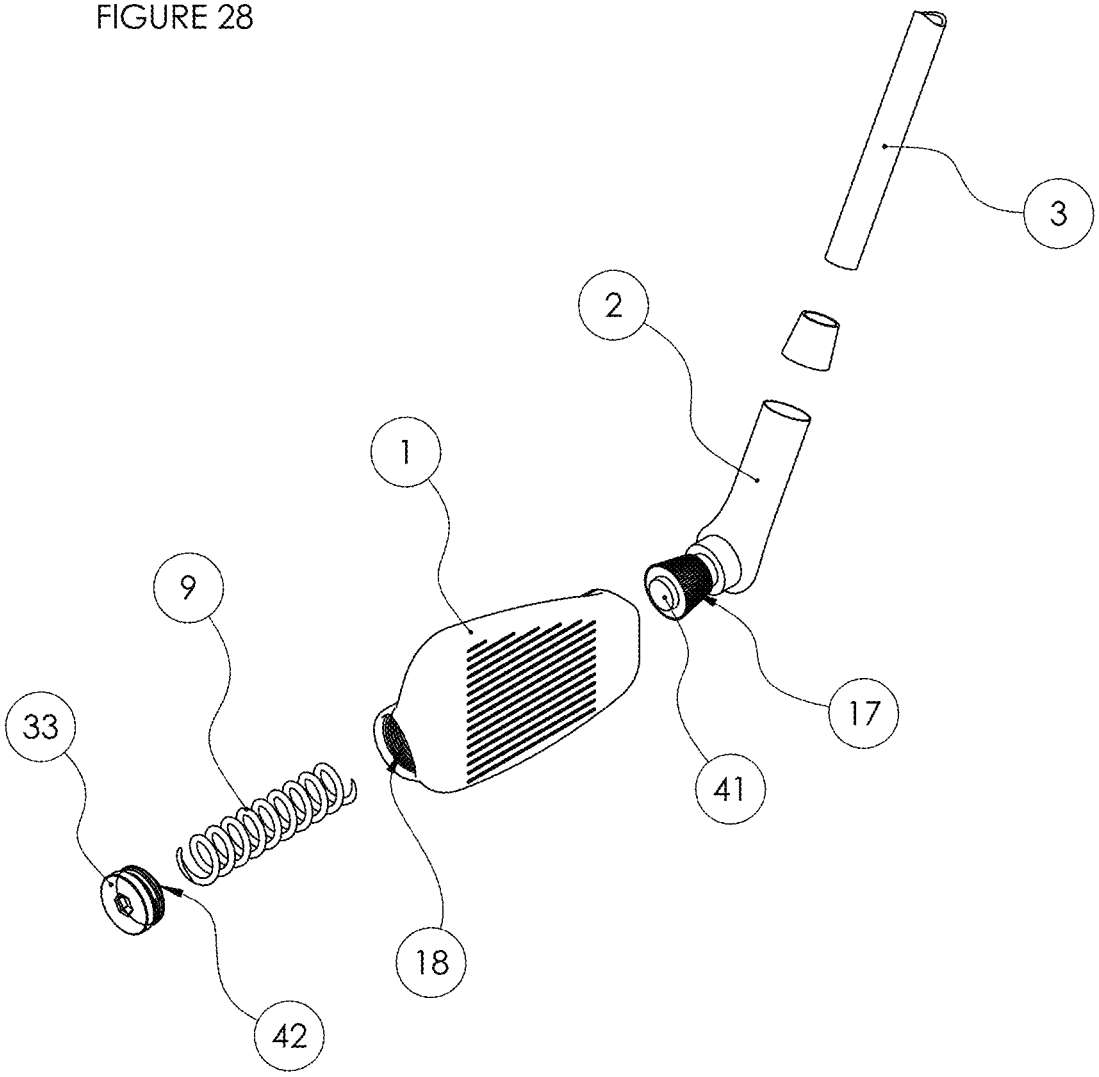
Figure 29:
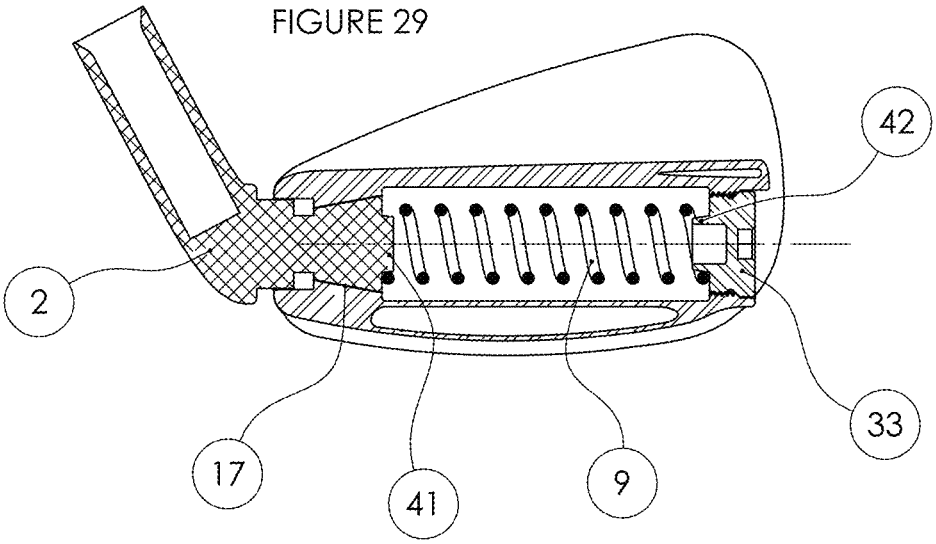
Figure 30:
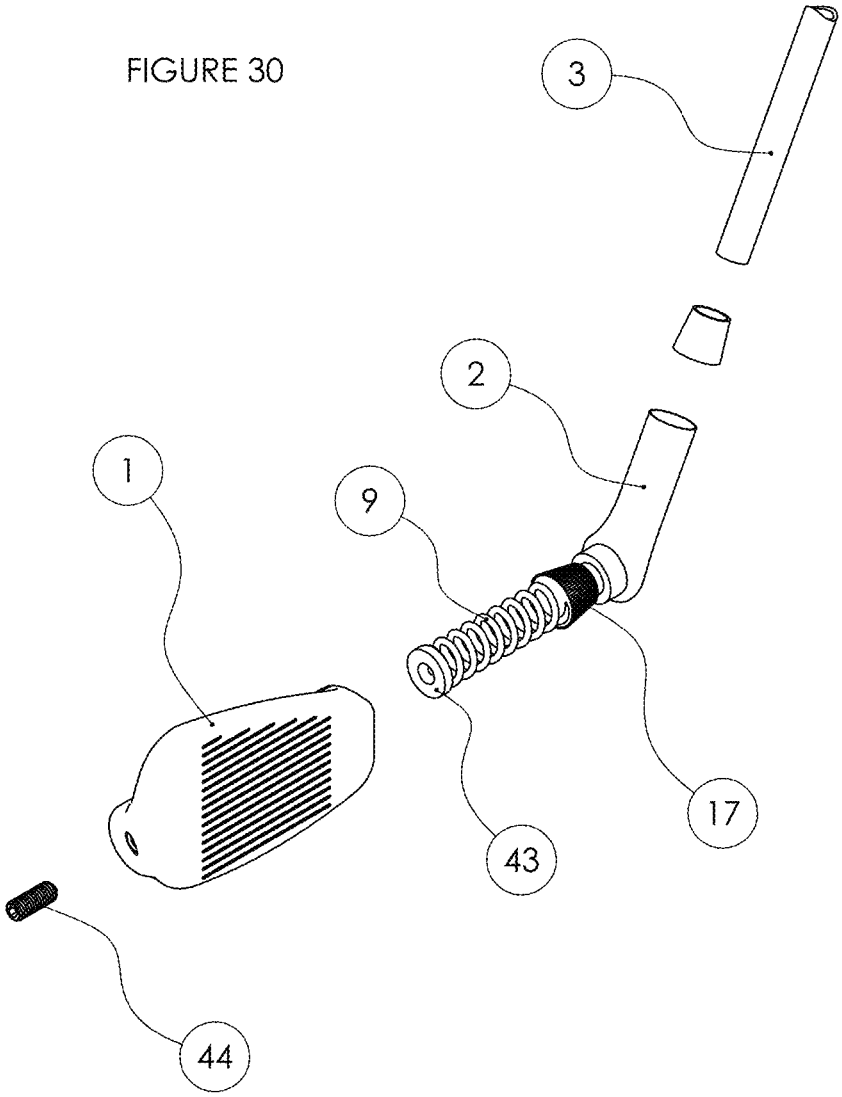
Figure 31:
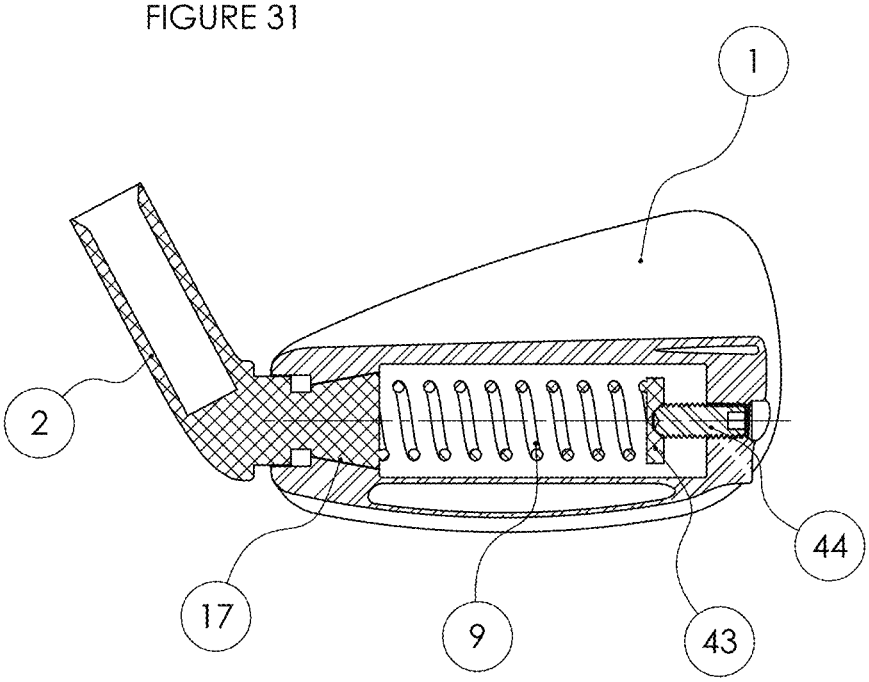

FIG. 4*a* illustrates the exterior of the club head of FIG. 4;

FIG. 5 illustrates the club in side view cross-section when the club's head is released for adjustment to another of the loft settings;

FIG. 5*a* illustrates the exterior of club of FIG. 5 in isometric view when the club head is released for adjustment;

FIG. 6 illustrates a hosel of the club in various isometric detail;

FIG. 6*a* illustrates the hosel of the club in side view;

FIG. 7 illustrates slip teeth forming part of the club's head;

FIG. 8 illustrates detail of the slip teeth;

FIG. 9 is an exploded view showing some key detail of a loft adjustable club according to a second embodiment of the invention;

FIGS. 10*a* & 10*b* show cross-section detail of parts of the second embodiment;

FIGS. 11*a* & 11*b* show cross-section detail for the second embodiment at two stages of movement;

FIGS. 12*a* & 12*b* show detail of slip teeth forming part of the second embodiment;

FIG. 13 is an exploded view showing some key detail of a loft adjustable club according to a third embodiment of the invention;

FIGS. 14*a* & 14*b* show cross-section detail for the third embodiment at two stages of movement;

FIGS. 15*a* & 15*b* show detail of slip teeth forming part of the third embodiment;

FIG. 16 is an exploded view of a loft adjustable golf club according to a further embodiment of the invention;

FIG. 17 illustrates internal assembly detail of the FIG. 16 club;

FIG. 18 illustrates detail of slip cogs forming part of the FIG. 16 embodiment;

FIGS. 19A-C illustrate the manner in which slip cogs forming part of the FIG. 16 club move;

FIG. 20 is a side cross-section view of the FIG. 16 club when set in one of its loft positions;

FIG. 21 is a side-cross section view of the FIG. 16 club when partially adjusted to another of its loft positions;

FIGS. 22-26 Illustrate an anti-rattle mechanism of the FIG. 16 club;

FIG. 27 illustrates a further version of the FIG. 16 club, but without a floating slip cog;

FIGS. 28-29 illustrate a further embodiment of the invention, with no slip cogs and a single spring unsupported through its centre;

FIGS. 30-31 illustrate a further version of the FIGS. 28-30 club.

DETAILED DESCRIPTION

Embodiment 1

Figure 1:
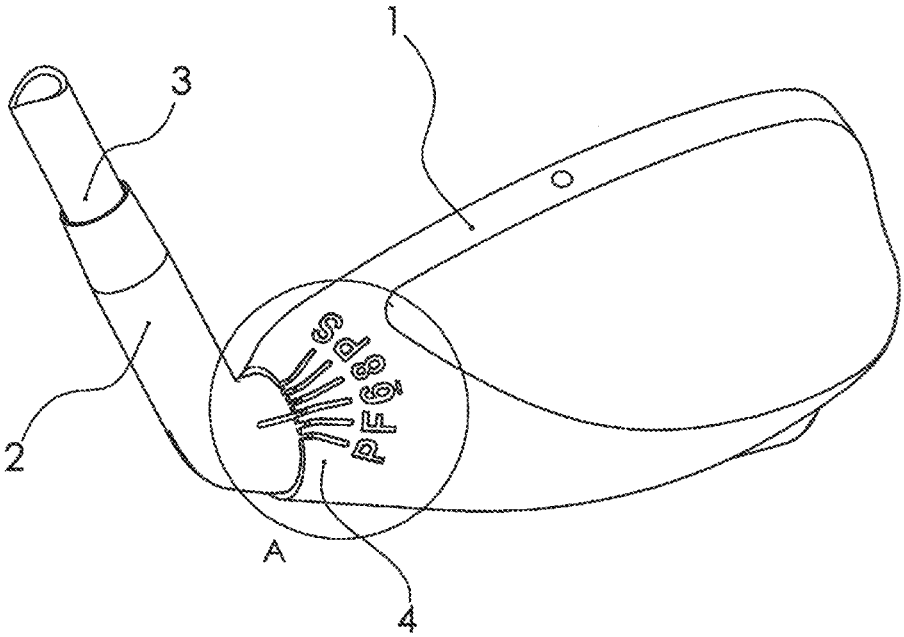
Figure 1:
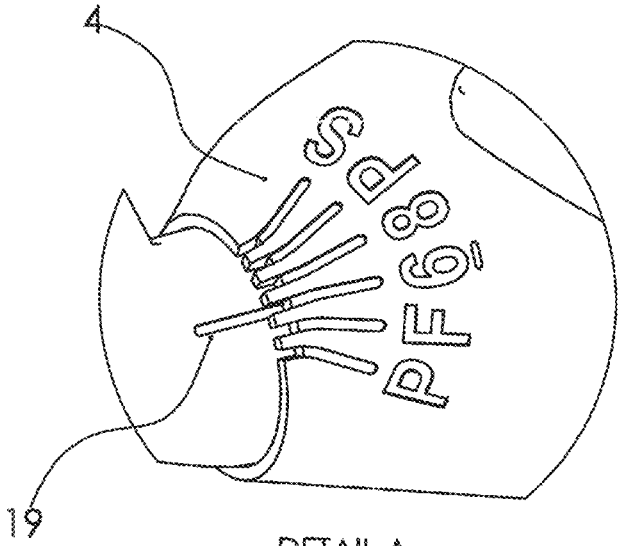
Figure 1A:
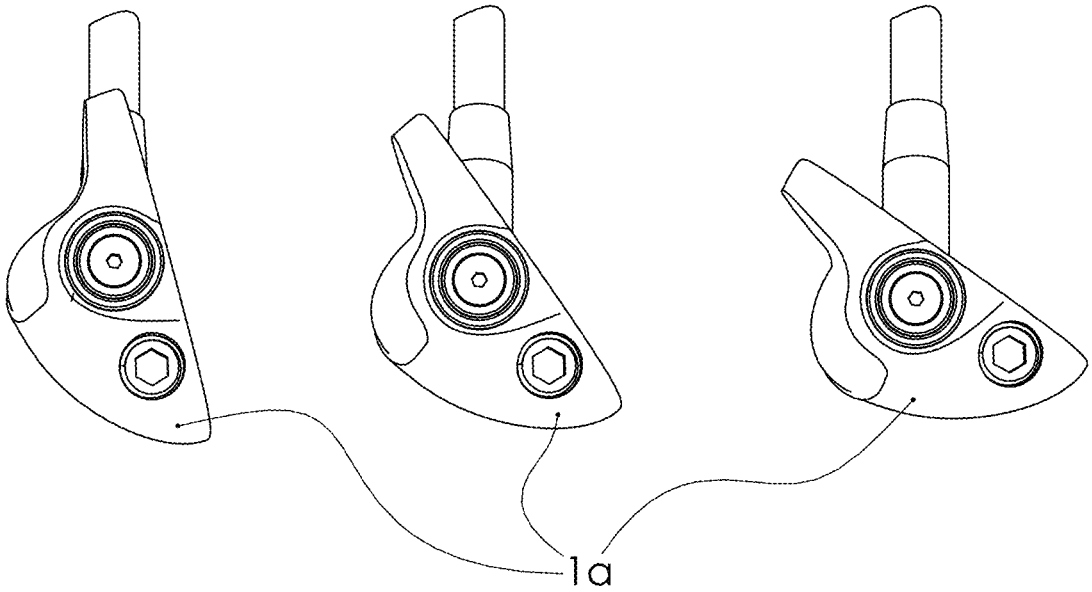
Figure 1B:
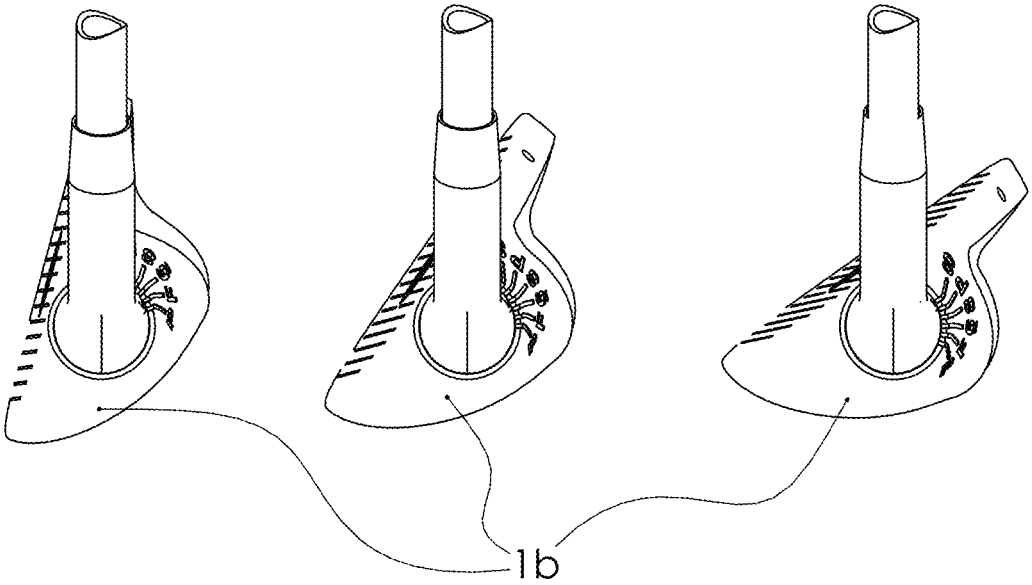

Referring to FIG. 1, the golf club has a ball striking head 1 and a hosel 2 for connection to a golf shaft 3. As is normal, the upper end of the shaft 3 serves as a hand grip or handle for swinging the club. In this case the arrangement is such that the head 1 can be moved by hand with respect to the hosel and locked into any of the loft settings 4, being P, F, 6, 8, W or S. This notation stands for putter, fairway driver, 6 iron, 8 iron, pitching wedge and sand wedge. In this example the loft angles for these are 5°, 15°, 25°, 35°, 45° and 55° respectively, however in other embodiments they may be in any other useful combination of angles. FIG. 1*a* illustrates the head when in the loft settings F, 8 and S, viewed from the toe 1*a* end of the head 1, and FIG. 1*b* shows corresponding views from the heel 1*b* end of the head 1.

Figure 2:
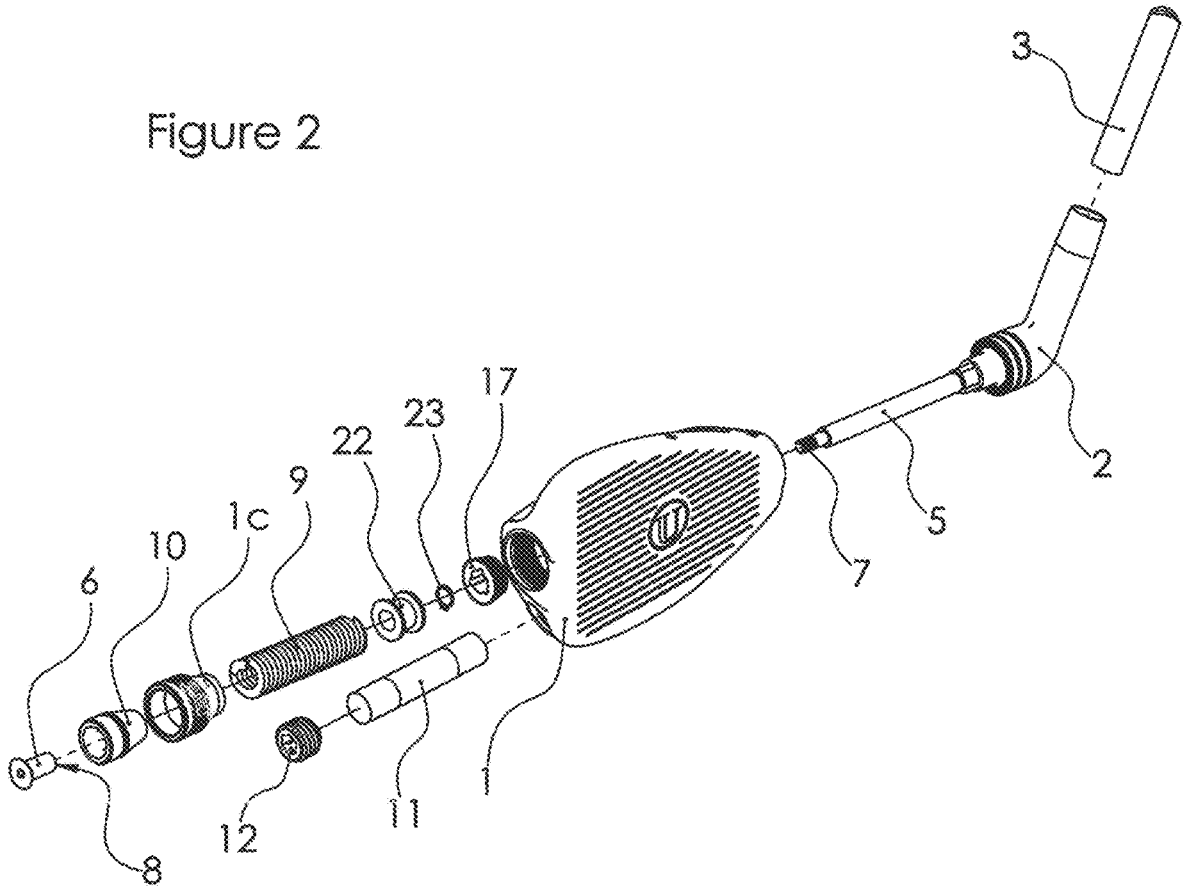
FIG. 2 is an exploded isometric view showing some components of the club.
Figure 3:
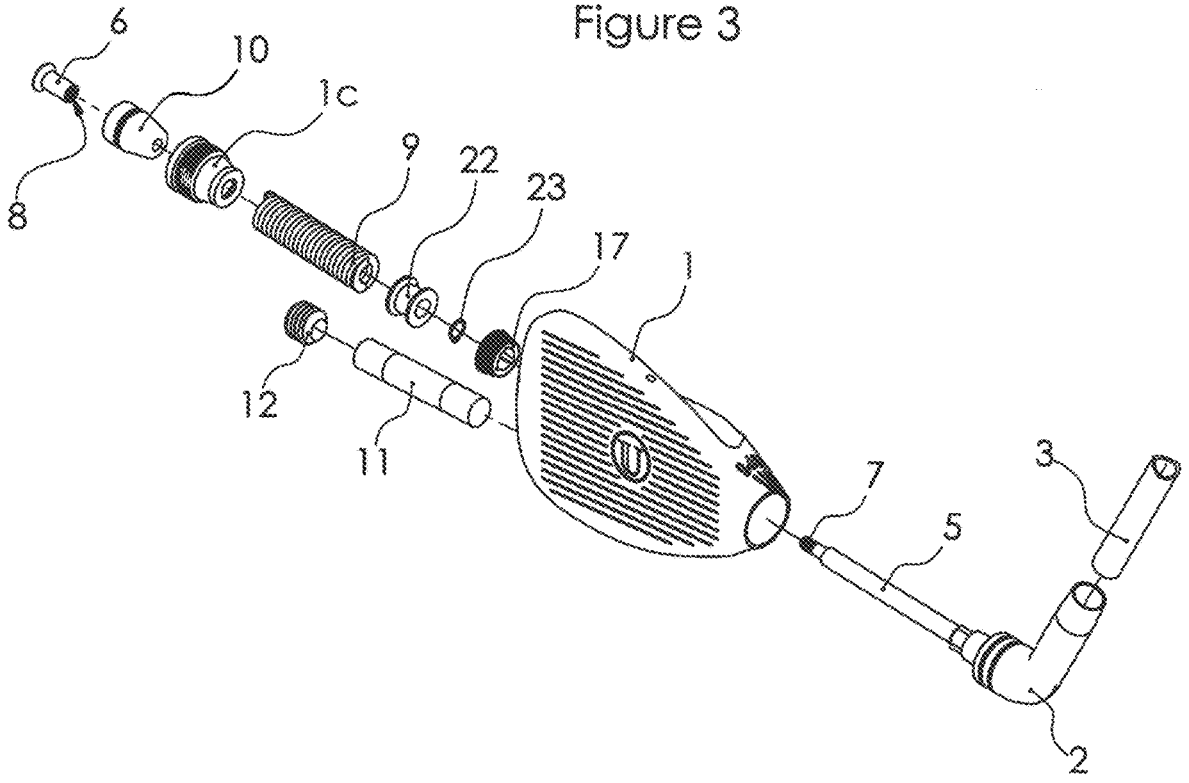
FIG. 3 is an alternative exploded isometric view showing the same components.

FIGS. 2 & 3 show some components of the club prior to assembly. The hosel 2 has a cylindrical shank 5 arranged to extend into a space inside the head 1 and connect to a nut 6 at the toe end of the head. To enable this, the distal end of the shank has a male screw thread 7 and the nut has a complimentary female thread 8. The arrangement is such that shank 5 passes through a spring 9 inside the head 1, and the nut 6 sits inside a complimentary shaped retainer 10. A spacer 22 may be used to configure the compression tension that the spring is under. A cylindrical weight 11 is arranged to sit snugly but removably in a further space inside the head and is held there by a grub screw 12. The weight 11 is to help 'balance' the club and can be replaced by a heavier or lighter similar weight to suit the person using the club.

Referring to FIG. 4, the retainer 10 sits inside a sleeve 1*c* that may be considered to be part of the head 1 (in this example the sleeve 1*c* is screw-fitted to the rest of the head 1). The arrangement is such that the spring 9 is under compression to provide a force that seeks to urge the head 1 outwards away from the heel end of the club. However the head 1 and hosel 2 are not able to separate because a contact surface 13 of the liner 1*c* butts against a complimentary contact surface 14 of the retainer 10. In other words the spring 9 is unable to move the head outwards beyond the shank 6 and retainer 10. Similarly, a further shoulder 15 of the liner 10 butts against a shoulder 16 of the nut 6 to help keep the liner and the nut together. FIG. 4*a* shows the exterior of the head 1 and hosel 2 when in the FIG. 4 disposition. An axial retainer or circlip 23 may be used to assist in in securing male teeth 17 (see FIG. 2).

FIG. 5 illustrates the same components as FIG. 4, but when the head 1 has been pushed inwards by hand towards the heel of the club (i.e. to the right in the drawing) to compact and overcome the biasing force of the spring 9. This is done to release the club for adjusting the angle between the head and hosel. What the movement does is cause complimentary male 17 and female 18 conical or otherwise tapered 'fin-like' or 'spline' teeth internal to the heel end of the head to disengage (the male teeth 17 are an integral or connected part of the hosel 2 and the female teeth 18 are an integral or connected part of the head 1). The teeth 17 and 18 may be considered 'conical' in that they run in straight lines to generally provide the periphery of a cone shape. The male teeth 17 may be secured to the shank 5 using a circlip (see FIG. 2). The disengagement of the teeth 17, 18 enables the head to be turned with respect to the hosel by hand. This has the effect of changing from one to another of the loft settings 4 (the settings are shown in FIG. 1). When the hand force that overcomes the bias of the spring 9 is released, the spring pushes the head back to the FIG. 4 arrangement so that the teeth 17, 18 reengage to lock the head in the new loft setting. The arrangement is generally that of a smaller conical set of teeth 17 fitting into a larger conical set of teeth 18. FIG. 5*a* shows the exterior of the hosel and club head when in the FIG. 5 disposition.

Referring again to FIGS. 4 and 5, swinging the club in a normal golf swing generates a centrifugal force that seeks to urge the head 1 away from the hosel 2. However in this case that force actually serves to press the teeth 17, 18, and therefore the head and hosel, into a tighter locking engagement rather than pull them apart. This occurs because the teeth 18 associated with the head are 'female' to the 'male' teeth 17 of the hosel, and both are tapered outwards towards the toe end of the club. As the narrower (right hand) end of the female teeth 18 try to move outwards (to the left) they run hard into the progressively spreading (left hand end) taper of the male teeth 17. The result is a locking impasse between the head 1 and the hosel 2.

FIGS. 6 & 6*a* illustrates detail of the hosel 2. An index line 19 enables the correct alignment of various loft settings 4, which can also be seen in FIG. 1. As shown in FIG. 6, the heel end of the hosel has a series of radial slip teeth 20 extending outwards, behind and spaced from the locking teeth 17. These slip teeth 20 are arranged to engage with complimentary radial slip teeth of the head. While the two sets of slip teeth are meshed/engaged, when the head is turned into or out of one of the loft settings 4 they are able to ride over one another and, as a consequence, the person turning the head hears 'clicks' and feel bumps as they clash. This gives the user a nice audible and 'tactile' impression during loft adjustments. FIG. 6*a* illustrates an example of an anti-rotation feature in the hosel, being keys 24 at the beginning of the shank, arranged so that the male splines 17 cannot rotate relative to the hosel. The slip teeth 21 of the head are shown at FIG. 7.

FIG. 8 illustrates the female teeth 18 connected to the rest of the head 1. Alternatively, the teeth may be formed as an integral part of the head.

While the preferred embodiments described above involve a combination of a tapered splines at the heel end, and a pair of complimentary contact surfaces at the toe end, in other embodiments of the invention there may be two tapered spline pairs—one at the heel and one at the toe.

Embodiment 2

FIG. 9 illustrates an alternative embodiment of a loft adjustable golf club according to the invention. For convenience the same numbering will be used for parts that are the same or substantially equivalent to those mentioned above. The club has a ball striking head 1, a hosel 2 and a shaft 3. The upper end of the shaft 3 serves as a handle for swinging the club. The hosel incorporates a cylindrical shank 5 that receives a cone-like set of longitudinally tapered male teeth 17. The arrangement is such that the interior of the male teeth 17 have slots that are complimentary with and engage keys 24 forming part of the shank 5. The keys 24 prevent the male teeth 17 from rotating with respect to the shaft 5. The drawing does not show the equivalent of the tapered female teeth 18 described previously because in this instance they are within the head. However the lock and release engagement between the male and female teeth 17, 18 is the same as described previously.

With further reference to FIG. 9, the mechanism includes a tube 25 through which the shank 5 passes inside the head 1. As shown, the heel end of the tube has a ledge 26. The arrangement is such that spring 9 extends around the narrow portion of the tube 25 but is not able to push past the ledge 26. The ledge 26 also contacts and prevents longitudinal movement, or in other words prevents axial movement, of the male teeth 17. The toe end of the tube 25 passes through an inner slip cog 27. The slip cog 27 is able to slide longitudinally with respect to the tube 25, but cannot rotate around it. A further feature of the slip cog 27 is that it has a ring of slip teeth 28 facing the toe end of the club. These engage with a complimentary inward facing ring of slip teeth 29 of an outer slip cog 30. This outer slip cog 30 moves axially with the head, and turns with the head when the head is rotated.

Still with FIG. 9, a barrel nut 6 is threaded to screw fit onto the distal end of the shaft 5 and tightens against a slider 31, which in turn presses against the tube 25. The arrangement is such that the slider 31 is trapped between the nut 6 and the tube 25. The slider 31 has grooves 32 which enable the inner slip cog 27 to move axially but not rotate. Finally, a retainer 33 is thread-fitted into the outer slip cog 30 to hold it in place.

Referring to FIGS. 10*a* and 10*b*, these show the FIG. 9 mechanism when assembled and with both sets of slip teeth 28, 29 interlocked. They are urged together by way by pressure from the spring 9 which is under compression.

When it is desired to adjust the loft of the club, the head 1 is moved towards the heel end of the club as before, to disengage the tapered sets of teeth 17, 18, so that the head can be rotated about the shaft 5 to bring the head into a different one of its loft settings. The movement from the locked to the unlocked positions is illustrated in FIGS. 11*a* and 11*b* respectively. When unlocked, the club head 1 is rotated by hand into the new loft setting. As this occurs, the slip teeth 28, 29 ride over one another as illustrated at FIGS. 12*a* and 12*b* and, as this occurs, they cause audible clicks and vibratory or bumping movements corresponding with each clash of teeth. This gives the person adjusting the club both audible and tactile feedback, which enhances the marketability and perceived quality of the club.

Embodiment 3

FIG. 13 illustrates a further alternative embodiment of the invention. It is largely similar to Embodiment 2 described above, and for that reason more or less equivalent parts have been given the same reference numbers. Substantially the only difference to Embodiment 2 is that in Embodiment 3 the inner slip cog 27 is shorter and there is no slider 31. The tube 25 prevents axial movement of the inner slip cog 27. And the spring 9 is, again, always in compression and has one end in contact with the outer slip cog 30 and its other end in contact with the retainer 33. Also again, the inner slip cog 27 is unable to rotate or slide with respect to the tube 15. The outer slip cog 30 can move axially inside the head 1, cannot rotate relative to the head, and is pressed against the inner slip cog 27 by the spring 9. FIGS. 14*a* and 14*b* show Embodiment 3 when the male and female teeth 17, 18 are locked and unlocked respectively. FIGS. 15*a* and 15*b* illustrate how the slip teeth 28, 29 ride over one another to product clicking a sound and tactile bumps in the same way described above.

While the preferred embodiments described above involve a combination of tapered splines at the heel end, and a pair of complimentary contact surfaces at the toe end, in other embodiments of the invention there may be two tapered spline pairs—one at the heel and one at the toe.

Embodiment 4

FIGS. 16 and 17 illustrate a loft adjustable golf club that represents a further alternative embodiment of the invention. For the most part substantially similar parts to those mentioned have been given the same reference numbers.

The club has a head 1, a hosel 2 and a handle 3. As shown, the hosel 2 incorporates a shortened shaft 5. A set of conical male locking teeth 17 are supported on the shaft 5, and are adapted to engage a complimentary conical set of female locking teeth 18 that are integral with an internal part of the head 1. As above, these sets of teeth 17, 18 each taper from a narrower end nearest the heel of the club to a wider end nearer the toe end of the club.

The head 1 can be moved by hand axially towards the heel of the club to disengage the teeth 17, 18 so that the head can be partly rotated to adjust it into one of several available loft settings. When the hand force that caused the axial movement is relaxed the teeth 17, 18 automatically engage one another under spring tension to lock the club in the respective loft setting. This tension is provided by a spring 9 that works to urge the female teeth 18 against the taper, or bank, of the male teeth 17. As shown, the central portion of the spring 9 has nothing supportive extending through it (eg it has no central supportive shaft or the like). Because of the compression in the spring 9, the natural inclination of the head is 1 to pull away from the hosel, but it cannot because the narrow heel end of the female teeth 18 cannot slide past the widening taper of the male teeth 17. Again, this lock is enhanced by centripetal force when the club is swung to hit a golf ball in the normal way.

As illustrated, the spring 9 is located at the toe end of the club on a retainer 33 that is screw fitted to the head 1. The other end of the spring is located against a top hat shaped thrust pad 34, that in turn engages the distal end of a barrel nut 35. The other end of the barrel nut 35 is screw threaded around the shank 5 to fasten them to one another. A second spring 37 is coiled around the barrel nut and maintained under compression between an arrangement of slip cogs at the heel end, and a washer 36 at the barrel nut. As shown, the washer 36 locates against the side of the barrel nut nearest the heel end of the club. As shown in FIG. 17, the arrangement of slip cogs comprises an inner slip cog 27 and an outer slip cog 30, which together sandwich a medial floating slip cog 38. As illustrated, the inner slip cog 27 buts against the set of male teeth 17 and the outer slip cog 30 buts against the second spring 37.

As shown in FIG. 18, the floating slip cog 18 has a series of radial right-angled teeth at each side to engage, respectively, with complementary shaped teeth of the inner and outer slip cogs. The three slip cogs are constantly held against one another by pressure from the second spring 37. This means that they stay engaged even when the head 1 is moved axially towards the heel end of the club for adjusting the loft setting. The second spring 37 preferably provides a significantly stronger tension than the other spring 9. However this does not hamper the axial movement of the head for loft adjustment, that is because a golfer only needs to overcome the lessor tension of the spring 9 to do this.

When the head 1 is rotated to adjust the loft setting, the teeth of the slips cogs ride over one another so that the golfer hears one click sound and also feels one bump, for each level of adjustment. For example if the golfer hears two clicks and feels two bumps, they know they have adjusted the club by two loft settings, such as from say a 7-iron setting to a 9-iron setting. This means that golfers with limited vision (eg those who normally need reading glasses) can know what loft setting they have the club in without having to view its marker scale. Of course as the teeth ride over one another they work against the tension of the second spring 9.

Referring again to FIG. 18, when the club head 1 is rotated in one direction then one side of the floating slip cogs' 38 teeth will be involved in causing the clicking, and when the head 1 is rotated the opposite direction the opposite side of the floating slip cog's 38 teeth will be involved in causing the clicking. Therefore, in one direction of rotation the teeth of the outer slip cog 30 will clash and cause click with those of the floating slip cog 38, and in the other direction of rotation the teeth of the inner slip cog 27 will clash and cause a click with the teeth of the floating slip cog 38. Further, when the outer slip cog 30 is moving, the inner slip cog 27 is not, and vice versa. As will be appreciated, the rotational movement of each of the inner and outer slip cogs is ratchet-like, in that they can each only rotate in one direction. FIGS. 19A-C illustrate the clashing of the various different slip cog teeth depending on the direction of rotation.

FIG. 20 illustrates, in side-view, the embodiment of FIGS. 16-19 when the club head 1 is locked in a loft setting. FIG. 21 shows the same arrangement of parts but when the head 1 has been moved axially towards to the heel end of the club to unlock the teeth 17, 18 for rotationally adjusting the loft of the club.

Referring to FIGS. 22-26, the outer slip cog 30 has a pair of diametrically opposed anti-rattle teeth 39. When the club head 1 is moved axially towards the heel end for loft adjustment, these teeth 39 are located in complimentary slots 40 in the head. The engagement serves to arrest rattle between the head and the hosel as loft adjustment occurs. However when the loft has been set and the club is ready to use, the teeth 39 are each free of their respective slot 40.

FIG. 27 illustrates an arrangement similar to that of FIGS. 16 and 17, except it does not involve a floating slip cog 38. In that case the teeth of the inner 27 and outer 30 slip cogs may ride over one another to cause the clicking and bumps noticed by the golfer during loft adjustment. To facilitate this, the teeth are not shaped to ratchet, but rather they can ride over one another in either direction of rotation.

Embodiment 6

FIGS. 28 and 29 illustrate a loft adjustable golf club that represents a further embodiment of the invention. Parts that are substantially similar to those mentioned have previously been given the same reference numbers.

The club has a head 1, hosel 2 and handle 3 as before. It also has conical set of male teeth 17 and a complementary conical set of female 18. These function in the manner described above, to releasably lock the club in whatever loft angle it has been set to.

In this embodiment the male teeth are preferably integral with the hosel, and the hosel has no shaft. Rather, the spring 9 that biases the sets of teeth 17, 18 to a locked position sits around a stump 41 of the set of male teeth at one end, and around a stump 42 of the retainer 33 at the toe end of the head. The spring 9 is under compression so that it naturally urges the head 1 away from the hosel, and this of course serves to lock the teeth 17, 18 in the manner described above. But when the club head is moved by hand axially towards the heel end of the club, the teeth 17, 18 are released so that the head 1 can be moved in a rotational manner to change the club's loft setting. The spring 9 does not have any supportive shaft extending through its axial centre.

FIGS. 30 and 31 show a similar arrangement to FIGS. 28 and 29, except that the spring 9 sits in a recess 43 in the front face of the set of male teeth 17, rather than around a stump. The opposite end of the spring 9 presses against a disc 43 that is screw fitted to, or otherwise located into, a grub screw 44. The grub screw is also screw fitted to the toe end of the head, and can be screw advanced to a greater or lesser extent to regulate the tension on the spring 9.

In other embodiments of the invention the golf club of any of the above embodiments may be modified so that the male locking gear is associated with the head 1 and the female locking gear 18 is associated with the hosel. In that instance the taper of these gears will in each case be opposite to that for the embodiments above. In other words the cone of each gear 17, 18 will be wider nearer the heel end than the toe end.

While some forms of the invention have been described by way of example, it should be appreciated that modifications and improvements can be made without departing from the scope of the following claims.

In terms of disclosure, this document envisages and hereby posits any feature mentioned herein in combination with itself or any other feature or features mentioned herein, even if the combination is not claimed.

We claim:

1. A golf club or part thereof, comprising:

a ball-strike head having a toe end;

a hosel having a shank that extends along at least part of, and that engages with, the head; and biasing means that provides a locking force that seeks to move the head and hosel apart and, in doing so, causes the head to remain locked in one or other of a selection of loft settings;

the golf club or part thereof being such that hand force can be applied to move the head inwards to overcome the locking force to free the head to be turned into another of the loft settings, and such that subsequent reverse movement of the head will cause it to be locked in that other setting;

wherein the head has a series of locking teeth and the hosel has a series of locking teeth, these being arranged such that they intermesh to lock the head in any of the loft settings and subsequently disengage when the head has been moved by hand to overcome the locking force to enable the head to be turned to another of the loft settings; and the two series of locking teeth are in a male-female engagement wherein the teeth of the hosel are male and the teeth of the head are female, and each set of teeth is formed to have a substantially conical shape and tapers outwards in the direction of the toe end, such that when the golf club is swung in a normal golf swing, a centrifugal force from the swing urges the teeth of the head tighter against the teeth of the hosel resulting in locking effect.

2. A golf club or part thereof according to claim 1, formed such that the locking force bias drives the head outwards to cause the head to be locked in said other setting.

3. A golf club or part thereof according to claim 2, wherein the biasing force is provided by a spring.

4. A golf club or part thereof according to claim 3, wherein the spring is arranged around the shank.

5. A golf club or part thereof according to claim 1, wherein the locking teeth of the head and the hosel each comprise a set of radially longitudinally extending teeth.

6. A golf club or part thereof according to claim 5, wherein the hosel's set of teeth sleeve-fit into, and mesh with, the head's set of teeth when the head is locked in any one of the loft settings.

7. A golf club or part thereof according to claim 6, comprising a nut fitted to a toe end of the shank, a retainer secured to the shank by the nut, and the retainer being in butting relationship with the head when the head is locked in one of the loft settings so that the head cannot be pulled free of the shank.

8. A golf club or part thereof according to claim 7, wherein the butting relationship is between the retainer and a liner forming part of the head.

9. A golf club or part thereof according to claim 8, wherein the liner is releasably screw-fitted to another part of the head.

10. A golf club, comprising:

a ball-strike head having a toe end and a cone shaped series of locking teeth arranged such that each of these teeth extend in a straight line;

a hosel having a cone shaped series of locking teeth arranged such that each of these teeth extend in a straight line that compliments the cone shaped series of locking teeth of the head, and a shank that extends along at least part of, and that engages with, the head;

biasing means that provides a spring locking force that seeks to move the head and hosel apart and, in doing so, causes the head to remain locked in one or other of a selection of loft settings;

each of said cone shaped series of locking teeth tapers outwards in the direction of the toe end, the two series of locking teeth being arranged such that the cone shape of one sleeve-fits into the cone shape of the other in a meshed male-female relationship to lock them against rotation, and such that when the golf club is swung in a normal golf swing, a centrifugal force from the swing urges the series of teeth of the head tighter against the series of teeth of the hosel resulting in a locking effect, and wherein hand force can be applied to move the head inwards to free the head to be turned into another of the loft settings, and such that subsequent reverse movement of the head will cause it to be locked in that other setting.

11. A golf club or part therefor, having a toe end and a heel end, comprising:

a) a ball-strike head integral with or secured to a first locking gear comprising splines;

b) a hosel integral with or secured to a second locking gear comprising splines; and c) slip gears having a plurality of teeth;

the club or part therefor being formed such that:

the head and the hosel engage one another to releasably lock the head in one of a plurality of loft settings;

a first spring force acts on the locking gears to bias them to engage one another;

a second spring force acts on the slip gears to bias the teeth of one slip gear to engage with teeth of another;

hand force can be applied to the head to move it towards the heel of the club against the bias on the locking gears to unlock the head so that it can be hand rotated into another of the loft settings and then released such that the same bias causes the head to be locked in that other loft setting;

as the head is rotated into said other loft setting at least one of the slip gears rides over another of them to generate a click sound and/or a tactile indication to give a person adjusting the club audible and/or tactile feedback of the adjustment; and wherein the first spring force that acts on the locking gears and the second spring force that acts on the slip gears is provided by a common spring.

12. A golf club or part therefor according to claim 11, wherein the common spring is compressed to assert a force that urges the head away from the heel of the club and, at the same time, urges at least one of the slip gears to engage another.

13. A golf club or part therefor according to claim 11, wherein the spring force acting on the locking gears is provided by a first spring, and the spring force acting on the slip gears is provided by a second spring.

14. A golf club according to claim 11, wherein the first spring provides substantially less force than the second spring.

15. A golf club or part therefor according to claim 14, wherein the first and second springs comprise elongate coils that are arranged substantially in line with one another.

16. A golf club or part therefor according to claim 15, wherein a central portion of the first spring has nothing supportive extending through it (eg it is not associated with an internally arranged shaft or the like).

17. A golf club or part therefor according to claim 16, wherein the slip gears comprise an inner slip gear, a medial slip gear and an outer slip gear, the click sound being generated when teeth of one or other of the inner and outer slip gears clash with teeth of the medial slip gear.

18. A golf club or part therefor according to claim 16, wherein:

a) the first locking gear is a female gear and its splines run in a longitudinally tapered configuration and the taper extends from narrower to wider as it proceeds towards the toe end of the club; and b) the second locking gear is a male gear and its splines also run in a longitudinally tapered configuration and the taper extends from narrower to wider as it proceeds towards the toe end of the club.

* * * * *